US007506974B2

(12) United States Patent
Hirakawa

(10) Patent No.: US 7,506,974 B2
(45) Date of Patent: Mar. 24, 2009

(54) IMAGE FORMING APPARATUS

(75) Inventor: Takashi Hirakawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 498 days.

(21) Appl. No.: 11/235,233

(22) Filed: Sep. 27, 2005

(65) Prior Publication Data

US 2006/0066701 A1 Mar. 30, 2006

(30) Foreign Application Priority Data

Sep. 28, 2004 (JP) ..... 2004-282647

(51) Int. Cl.
*B41J 2/01* (2006.01)

(52) U.S. Cl. ..... 347/101; 347/104; 347/55; 399/271

(58) Field of Classification Search ..... 347/55, 347/105, 106, 111, 112, 126, 154
See application file for complete search history.

(56) References Cited

U.S. PATENT DOCUMENTS 5,477,250 A * 12/1995 Larson ..... 347/55
5,559,586 A * 9/1996 Wada ..... 399/271
5,825,384 A * 10/1998 Fujita ..... 347/55
5,903,291 A * 5/1999 Yoshimura et al. ..... 347/48
5,933,176 A * 8/1999 Wakahara ..... 347/112
6,309,064 B1 * 10/2001 Tanno et al. ..... 347/104
6,508,540 B1 * 1/2003 Lean et al. ..... 347/55
2004/0090487 A1 * 5/2004 Kanemura ..... 347/35
2005/0200644 A1 * 9/2005 Bradley ..... 347/19
2005/0270355 A1 * 12/2005 Sootome et al. ..... 347/104
2006/0214984 A1 * 9/2006 Hirakawa ..... 347/31

FOREIGN PATENT DOCUMENTS

JP 2-212149 A 8/1990
JP 5-4342 A 1/1993
JP 5-4343 A 1/1993

* cited by examiner

*Primary Examiner*—Luu Matthew
*Assistant Examiner*—John P Zimmermann
(74) *Attorney, Agent, or Firm*—Birch, Stewart, Kolasch & Birch, LLP

(57) ABSTRACT

The image forming apparatus comprises: an ejection head which forms an image on an ejection receiving medium, by ejecting liquid having electrorheological properties onto the ejection receiving medium; a holding device which holds the ejection receiving medium on a surface facing a liquid ejection surface of the ejection head; a conveyance device which conveys at least one of the ejection head and the ejection receiving medium held by the holding device relatively to each other in a conveyance direction; a first electrode group which includes at least a pair of a positive electrode and a negative electrode provided in the holding device, has a lengthwise direction coinciding with a sub-scanning direction substantially parallel to the conveyance direction of the conveyance device, and is disposed so as to be aligned with the main scanning direction substantially perpendicular to the sub-scanning direction; and a voltage supply device which supplies a prescribed voltage to the first electrode group.

7 Claims, 18 Drawing Sheets

IMAGE FORMING APPARATUS

BACKGROUND OF THE INVENTION

1. Field of the Invention

The present invention relates to an image forming apparatus, and more particularly, to image forming technology in an image forming apparatus using liquid which exhibits electrorheological properties.

2. Description of the Related Art

In recent years, inkjet recording apparatuses have come to be used widely as data output apparatuses for outputting images, documents, or the like. By driving nozzles provided in a print head in accordance with data, an inkjet recording apparatus is able to form data onto a recording medium, such as recording paper, by means of ink ejected from the nozzles.

If streaks, non-uniformities, or the like, occur, and color mixing arises whereby the inks of different colors mix together on the medium when a color image is formed, then the image quality declines markedly. In order to reduce decline in the quality of the print image, a method has been proposed in which an image is formed on media by using an ink having electrorheological (ER) properties which increases in viscosity when an electric field is applied to same.

In the image forming method described in Japanese Patent Application Publication No. 2-212149, an electrorheological fluid is used as a recording material having electrorheological properties, and by applying an electric field to the recording member after applying the recording material to the recording member, permeation of the recording material into the recording member is prevented, and streaking, decline in recording density, and the like, are prevented.

In the recording apparatus described in Japanese Patent Application Publication No. 5-4342, a recording liquid having electrorheological properties is applied by a recording head to an intermediate medium on which an electric field is formed, excessive spreading or color mixing of the dots is prevented by increasing the viscosity of the recording liquid on the intermediate transfer medium, and transfer from the intermediate transfer medium to a transfer receiving medium is performed when the recording liquid is in a state of increased viscosity due to drying, or a state of increased viscosity due to the electrorheological properties of the recording liquid.

In the recording apparatus described in Japanese Patent Application Publication No. 5-4343, droplets of recording liquid having electrorheological properties are applied by a recording head onto a transfer receiving medium to which an electric field is applied, the viscosity of the recording liquid on the transfer receiving medium is increased, thereby preventing streaking, bleeding, and color mixing of the dots formed by the recording liquid, and the electric field is maintained while the recording liquid proceeds to dry and permeate into the transfer receiving medium, until a stage where no bleeding or color mixing is produced.

In the image forming method described in Japanese Patent Application Publication No. 2-212149, and the recording apparatus described in Japanese Patent Application Publication Nos. 5-4342 and 5-4343, the electrorheological properties of a recording material or recording liquid are displayed by applying an electric field to a recording member, intermediate transfer body or transfer receiving medium, and in these methods, an electric field is not generated in the actual recording material or recording liquid itself, and therefore, it may be considered that the recording material or recording liquid cannot be made to display effective electrorheological properties.

SUMMARY OF THE INVENTION

The present invention has been contrived in view of the foregoing circumstances, an object thereof being to provide an image forming apparatus which forms desirable images free of unevenness, color mixing, or the like, by causing a liquid having electrorheological properties situated on a medium to display electrorheological properties reliably, thereby preventing deposition interference involving coalescence of mutually adjacent liquid droplets on the ejection receiving medium, displacement of the dot forming positions from the prescribed landing positions, or disturbance of the dot shapes.

In order to attain the aforementioned object, the present invention is directed to an image forming apparatus, comprising: an ejection head which forms an image on an ejection receiving medium, by ejecting liquid having electrorheological properties onto the ejection receiving medium; a holding device which holds the ejection receiving medium on a surface facing a liquid ejection surface of the ejection head; a conveyance device which conveys at least one of the ejection head and the ejection receiving medium held by the holding device relatively to each other in a conveyance direction; a first electrode group which includes at least a pair of a positive electrode and a negative electrode provided in the holding device, has a lengthwise direction coinciding with a sub-scanning direction substantially parallel to the conveyance direction of the conveyance device, and is disposed so as to be aligned with the main scanning direction substantially perpendicular to the sub-scanning direction; and a voltage supply device which supplies a prescribed voltage to the first electrode group.

According to the present invention, the holding device which holds an ejection receiving medium when liquid is ejected from an ejection head comprises a first electrode group having a lengthwise direction coinciding with a sub-scanning direction, which is substantially parallel to the conveyance direction of the conveyance device, and an electric field in a direction (main scanning direction) substantially perpendicular to the sub-scanning direction is applied by the first electrode group to the liquid having electrorheological properties ejected from the ejection head.

Generally, a liquid having electrorheological properties has characteristics whereby the viscosity in the direction of the applied electric field has the highest value compared to the viscosity in other directions, and since an electrical field is applied to the liquid in the main scanning direction, the viscosity in the main scanning direction is raised higher than the viscosity in the other directions, and therefore, deposition interference between the liquids occurring in the main scanning direction is suppressed, and a desirable image which avoids non-uniformities, or the like, can be formed.

The liquid includes various types of liquid which may be ejected in the form of liquid droplets from the ejection apertures (nozzles) of an ejection head, such as ink, resist, liquid chemical, treatment liquid, or the like.

The ejection head may be a full line type ejection head in which ejection apertures are arranged through a length corresponding to the entire width of the ejection receiving medium, or a serial type ejection head (shuttle scanning type recording head) in which a short head having ejection apertures arranged through a length that is shorter than the entire width of the ejection receiving medium ejects liquid droplets onto the ejection receiving medium while scanning in the breadthways direction of the ejection receiving medium (main scanning direction).

Moreover, "ejection receiving medium" indicates a medium which receives a liquid ejected from an ejection head, and this term includes various types of media, irrespective of material and size, such as continuous paper, cut paper, sealed paper, resin sheets, such as OHP sheets, film, cloth, and other materials. The "recording medium" may also be referred to as "recording media, print medium, image forming medium", and so on.

Here, an "image" means an image in the broad sense of term, including text, line drawings, dots, and the like, as well as pictures and photographs, and it may also include a wiring pattern formed on a substrate, for example.

Furthermore, the denomination of positive electrodes and negative electrodes indicates their respective relationship, and means that the electric potential of the positive electrodes is relatively greater than the electric potential of the negative electrodes.

A desirable mode is one in which a minimally conductive member (minimally conductive layer) having prescribed conductive properties (properties whereby it transmits at least a portion of the electric field generated by the first electrode group) and prescribed insulating properties is provided between the first electrode group and the ejection receiving medium.

For the holding device, it is possible to use members of various shapes, such as a belt shape, a drum shape, a plate shape, or the like.

Preferably, the ejection head comprises a full-line head having at least one row of ejection apertures of a length corresponding to an image formable width of the ejection receiving medium; and single-pass driving for causing the liquid to be ejected onto the ejection receiving medium is performed by causing the ejection head to scan the ejection receiving medium only once in the sub-scanning direction.

When an image is formed by single-pass driving, using a full line type ejection head, then if deposition interference occurs in the main scanning direction in the liquid on the ejection receiving medium, banding or streaking in the sub-scanning direction will arise in the image formed on the ejection receiving medium. Therefore, deposition interference of the liquid in the main scanning direction is avoided by applying an electric field acting in the main scanning direction to the liquid on the ejection receiving medium, and thus increasing the viscosity of the liquid in that direction.

A full line ejection head may be formed to a length corresponding to the full width of the recording medium by combining short head having rows of ejection apertures which do not reach a length corresponding to the full width of the ejection receiving medium, these short heads being joined together in a staggered matrix fashion.

Preferably, the ejection head has a two-dimensional arrangement in which a plurality of ejection aperture rows are arranged in the sub-scanning direction.

A mode is also possible in which the two-dimensional arrangement involves arranging ejection apertures in an oblique direction forming a prescribed angle θ (where $0<\theta\leqq 90°$) with respect to the sub-scanning direction.

Preferably, at least a portion of the first electrode group has a structure in which the positive electrodes and the negative electrodes are arranged alternately in the main scanning direction.

By arranging the positive electrodes and the negative electrodes alternately in the main scanning direction, it is possible to intensify the electric field in the main scanning direction which is generated by the first electrode group. The number of positive electrodes and negative electrodes may be the same or it may be different, and the positive electrodes and the negative electrodes are preferably provided in equal numbers.

Furthermore, in a mode where a plurality of first electrode groups and second electrode groups are provided, the first electrode groups and second electrode groups may be arranged at equidistant intervals (in other words, symmetrically), or they may be arranged at different intervals (in other words asymmetrically).

Preferably, the image forming apparatus further comprises: a second electrode group which includes at least a pair of a positive electrode and a negative electrode disposed so as to be substantially perpendicular to the first electrode group; a second voltage supply device which supplies a prescribed voltage to the second electrode group; and an electrode group switching device which switches between supplying the prescribed voltage to the first electrode group and supplying the prescribed voltage to the second electrode group.

Since a second electrode group is provided so as to be perpendicular with respect with the first electrode group, it is possible to cause the liquid on the ejection receiving medium to display electrorheological properties, in such a manner that the viscosity in the sub-scanning direction is higher than the viscosity in the other directions, and therefore, deposition interference in the sub-scanning direction can be suppressed.

Furthermore, since an electrode group switching device for switching between supplying a prescribed voltage to the first electrode group (generating an electric field from the first electrode group) and supplying a prescribed voltage to the second electrode group (generating an electric field from the second electrode group) is provided, then it is possible to switch the direction of the electric field applied to the liquid on the ejection receiving medium, and therefore, to switch the direction in which electrorheological effects are displayed more strongly than the other directions, in the liquid.

The second voltage supply device may also serve as the first voltage supply device. Furthermore, the electrode switching device may also be incorporated into the power supply device.

Preferably, the electrode group switching device switches between supplying the prescribed voltage to the first electrode group and supplying the prescribed voltage to the second electrode group, in accordance with at least one of a type of ejection receiving medium and data of the image to be formed on the ejection receiving medium.

Since the liquid fixing characteristics and permeation characteristics vary depending on the type or ejection receiving medium, the direction in which the electric field is generated is switched accordingly.

In one mode, if the fixing time or permeation time of the ejection receiving medium is short (if the fixing speed or the permeation speed is fast), then an electric field is generated in the sub-scanning direction by using the second electrode group, and if the fixing time or permeation time is long (if the fixing speed of permeation speed is slow), then an electric field is generated in the main scanning direction by using the first electrode group.

Moreover, it is also possible to switch the direction of generation of the electric field (namely, which of the electrode groups to use), in accordance with the conveyance speed of the conveyance device (conveyance control) and/or the ejection frequency of the ejection head (ejection control).

Preferably, the image forming apparatus further comprises an electrode group switching control device which controls the electrode group switching device in such a manner that, the prescribed voltage is supplied to the first electrode group when suppressing deposition interference on the ejection receiving medium between droplets of the liquid ejected from different ejection apertures, and the prescribed voltage is supplied to the second electrode group when suppressing deposition interference on the ejection receiving medium between droplets of the liquid ejected from a same ejection aperture.

In particular, in an ejection head having a row of ejection apertures arranged in a matrix fashion, deposition interference occurs in the sub-scanning direction between liquids ejected from the same ejection aperture. On the other hand, in the case of liquids ejected from different nozzles (adjacent nozzles), deposition interference occurs in the main scanning direction.

For example, if the conveyance speed of the conveyance device is slow, or if an image of high density is formed, or the like, then the viscosity of the liquid should be raised in the sub-scanning direction when liquid is ejected consecutively from the same ejection aperture, and the viscosity of the liquid should be raised in the main scanning direction when liquid is ejected consecutively from different ejection apertures (adjacent ejection apertures).

If there is a possibility that deposition interference may occur in both the main scanning direction and the sub-scanning direction, then control should be implemented in such a manner that the viscosity of the liquid is raised in the main scanning direction.

Preferably, planar shapes of the positive electrode and the negative electrode constituting the second electrode group are comb shapes each having a plurality of comb tooth sections; and the second electrode group has a structure in which the comb tooth sections of the positive electrode and the comb tooth sections of the negative electrode are arranged alternately.

By disposing the respective comb tooth sections of the positive electrodes and the negative electrodes formed in a comb shape, in an alternating fashion, it is possible to apply an electric field of high intensity to the liquid deposited on the ejection receiving medium.

Preferably, the holding device has a laminated structure in which the first electrode group and the second electrode group are layered together.

By layering a first electrode group and a second electrode group, it is possible to arrange the first electrode group and the second electrode group, efficiently, inside the holding device. In order to ensure the insulating properties between the first electrode group and the second electrode group, a non-conducting member (non-conducting layer) having prescribed insulating properties is provided.

According to the present invention, the holding device which holds the ejection receiving medium comprises a first electrode group having at least one pair of positive electrodes and negative electrodes aligned in a sub-scanning direction which is substantially parallel to the conveyance direction of the conveyance device, and the viscosity of the liquid on the ejection receiving medium is raised to a maximum value in the main scanning direction, which is substantially perpendicular to the sub-scanning direction, compared to the viscosity in the other directions, by means of an electric field generated by the first electrode group. Therefore, deposition interference of the liquid in the main scanning direction is suppressed, and desirable images can be formed, which are free of banding, non-uniformities, or the like, aligned in the sub-scanning direction on the ejection receiving medium.

Furthermore, since a second electrode group is provided in a direction substantially perpendicular to the first electrode group, then an electric field in the sub-scanning direction can be generated by this second electrode group and hence it is possible to switch between the first electrode group and the second electrode group. Therefore, it is possible to control the direction in which the viscosity of the liquid becomes highest, in accordance with the type of ejection receiving medium and the image to be formed on the ejection receiving medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Composition of Inkjet Recording Apparatus

Figure 1:
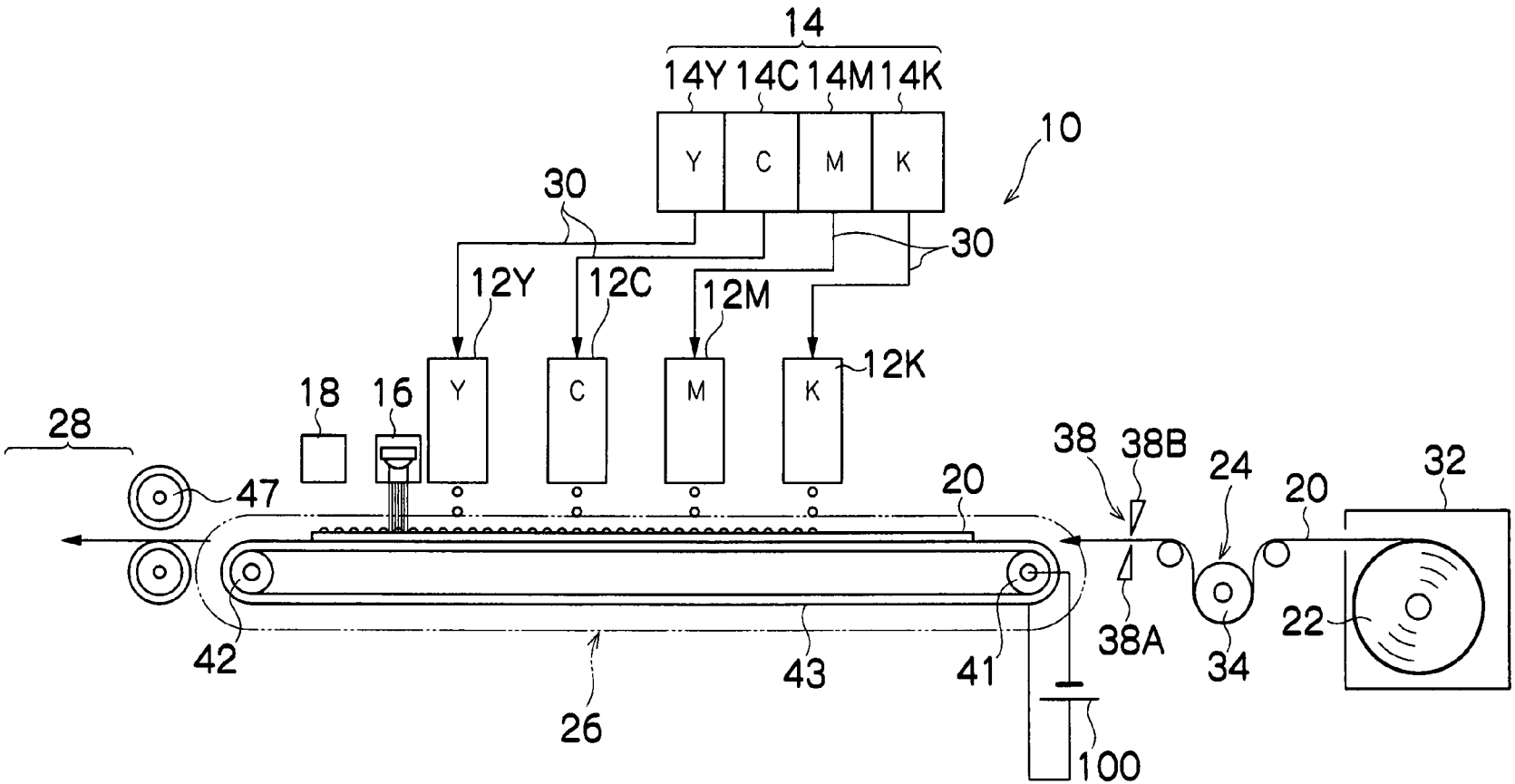
FIG. 1 is a basic schematic drawing of an inkjet recording apparatus according to an embodiment of the present invention.

FIG. 1 is a diagram of the general composition of an inkjet recording apparatus according to a first embodiment of the present invention. As shown in FIG. 1, the inkjet recording apparatus 10 comprises: a plurality of print heads 12K, 12M, 12C, and 12Y provided corresponding to the respective ink colors of black (K), magenta (M), cyan (C) and yellow (Y); an ink storing and loading unit 14 for storing inks (in the present embodiment, ultraviolet-curable inks having electrorheological properties) to be supplied to the print heads 12K, 12M, 12C, and 12Y; an ultraviolet light source 16 which solidifies ink droplets by irradiating ultraviolet light onto same; a print determination unit 18 for reading the printed results produced by the print heads 12K, 12M, 12C, and 12Y; a paper supply unit 22 for supplying recording paper (ejection receiving medium) 20; a decurling unit 24 for removing curl in the recording paper 20; a paper conveyance unit 26, disposed facing the nozzle faces (ink ejection faces) of the print heads 12K, 12M, 12C, and 12Y and the light ejection face of the ultraviolet light source 16, which conveys the recording paper 20 while keeping the recording paper 20 flat; and a paper output unit 28 for outputting printed recording paper (printed matter) to the exterior.

The ink storing and loading unit 14 has ink tanks 14K, 14M, 14C, and 14Y for storing the inks of K, M, C, and Y to be supplied to the print heads 12K, 12M, 12C, and 12Y, and the tanks are connected to the print heads 12K, 12M, 12C, and 12Y by means of prescribed channels 30. The ink storing and loading unit 14 has a warning device (for example, a display device or an alarm sound generator) for warning when the remaining amount of any ink is low, and has a mechanism for preventing loading errors among the colors.

In the present embodiment, an electrorheological fluid obtained by imparting an ultraviolet-setting ink with electrorheological properties is used as the printing ink. An electrorheological fluid is a fluid in which the apparent viscosity rises instantaneously when an electric field is applied. The change in viscosity is reversible by switching the electric field on and off. There are two types of electrorheological fluids: dispersed fluids and uniform fluids.

A dispersed type fluid is one in which dielectric micro-particles are dispersed in an electrically insulating solvent. This fluid behaves in such a manner that when no electric field is applied, the micro-particles remain in a dispersed state and the viscosity of the fluid is low, but when an electric field is applied, the polarized particles form chain-like structures ("bridges") linked in the direction of the electric field, and these bridges act so as to increase the viscosity of the fluid. Dispersed type electrorheological fluids include aqueous and non-aqueous fluids.

Uniform type electrorheological fluids are fluids having anisotropic properties in which molecules or domains are oriented in the direction of the electric field, such as in liquid crystals, or the like. In the present embodiment, the anisotropic characteristics of the electrorheological fluid are utilized to control the direction in which the viscosity of the liquid reaches a highest value, thereby suppressing interference effects such as coalescence or aggregation occurring between liquid droplets.

In the present embodiment, a radiation (e.g., ultraviolet, electron beam, etc.) curable ink is imparted with electrorheological properties, and an ink of this kind may be manufactured, for example, by dispersing solid micro-particles (silica gel, starch, dextrin, carbon, gypsum, gelatin, alumina, cellulose, mica, zeolite, kaolite, or the like) in a liquid containing at least a radiation-curable monomer and a polymerization initiator, by using the actual pigment micro-particles as a dispersant for creating an electrorheological effect, by forming the dye or pigment into micro-capsules, providing insulation on the surface thereof, and using these micro-capsules as a dispersant for creating an electrorheological effect, or by combining a uniform type electrorheological fluid.

In FIG. 1, a magazine 32 for rolled paper (continuous paper) is shown as an example of the paper supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of media can be used, it is preferable that an information recording medium such as a bar code and a wireless tag containing information about the type of media is attached to the magazine, and by reading the information contained in the information recording medium with a predetermined reading device, the type of media to be used is automatically determined, and ink droplet ejection is controlled so that the ink droplets are ejected in an appropriate manner in accordance with the type of media.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, of which length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

After decurling in the decurling unit 24, the cut recording paper 20 is delivered to the conveyance unit 26. The conveyance unit 26 has a configuration in which an endless belt-type electrode unit (electrostatic attraction belt) 43 is set around rollers 41 and 42 in such a manner that at least the portion of the endless belt 43 facing the nozzle faces of the print heads 12K, 12M, 12C, and 12Y forms a horizontal plane (flat plane).

If a DC high voltage is applied to the roller 41 by the DC high-voltage generator 100, then the belt type electrode unit 43 wound about the roller 41 becomes charged, and the recording paper 20 is attracted to and held on the belt type electrode unit 43 due to the effects of electrostatic attraction.

The belt type electrode unit 43 is driven in the counter-clockwise direction in FIG. 1 by the motive force of a motor 88 (not shown in FIG. 1, but shown in FIG. 8) being transmitted to at least one of the rollers 41 and 42, which the belt type electrode unit 43 is set around, and the recording paper 20 held on the belt type electrode unit 43 is conveyed from right to left in FIG. 1.

The internal structure of the belt type electrode unit 43 is described later.

Figure 2:
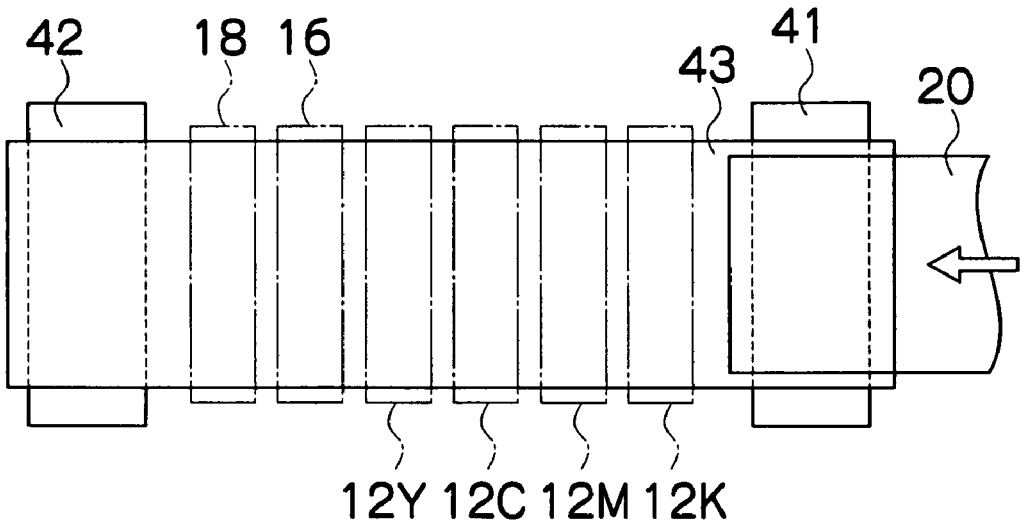
FIG. 2 is a plan view of the principal part of the peripheral printing region of the inkjet recording apparatus illustrated in FIG. 1.

The print heads 12K, 12M, 12C, and 12Y are full line heads having a length corresponding to the maximum width of the recording paper 20 used with the inkjet recording apparatus 10, and comprising a plurality of nozzles for ejecting ink arranged on a nozzle face through a length exceeding at least one edge of the maximum-size recording paper 20 (namely, the full width of the printable range) (see FIG. 2).

The print heads 12K, 12M, 12C, and 12Y are arranged in color order (black (K), magenta (M), cyan (C), yellow (Y)) from the upstream side in the feed direction of the recording paper 20, and these respective print heads 12K, 12M, 12C, and 12Y are fixed extending in a direction substantially perpendicular to the conveyance direction of the recording paper 20.

A color image can be formed on the recording paper 20 by ejecting inks of different colors from the print heads 12K, 12M, 12C, and 12Y, respectively, onto the recording paper 20 while the recording paper 20 is conveyed by the conveyance unit 26.

By adopting a configuration in which full line type print heads 12K, 12M, 12C, and 12Y having nozzles rows covering the full paper width are provided for each separate color in this way, it is possible to record an image on the full surface of the recording paper 20 by performing just one operation of moving the recording paper 20 relatively with respect to the print heads 12K, 12M, 12C, and 12Y in the conveyance direction of the recording paper (the sub-scanning direction), (in other words, by means of one sub-scanning action). A single pass image forming apparatus of this kind is able to print at high speed in comparison with a shuttle scanning system in which an image is printed by moving a print head back and forth reciprocally in the main scanning direction, and hence print productivity can be improved.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added. Furthermore, there are no particular restrictions on the sequence in which the print heads of respective colors are arranged.

The ultraviolet light source 16 disposed on the downstream side of the print head 12Y has a length corresponding to the maximum width of the recording paper 20, similarly to the print heads 12K, 12M, 12C, and 12Y, and it is fixed extending in a direction substantially perpendicular to the conveyance direction of the recording paper 20. For example, the ultraviolet light source 16 is constituted by a configuration of ultraviolet light-emitting diode (LED) elements or ultraviolet laser diode (LD) elements arranged in a line. According to this composition, since light emission can be controlled selectively in each individual light-emitting element, it is possible readily to adjust the light emitting elements that light up, and the amount of light generated, and hence a prescribed irradiation range and light volume (intensity) can be achieved in the ultraviolet irradiation area.

The ultraviolet light source 16 irradiates ultraviolet light in order to promote the hardening of ink droplets deposited by the print heads 12K, 12M, 12C, and 12Y on the upstream side thereof. Desirably, when the ink droplets are irradiated with ultraviolet light by the ultraviolet light source 16, they proceed to become cured and fixed to a degree whereby no image deterioration occurs during handling in subsequent processing on the downstream side. Here, this "handling" means, for example, (1) rubbing of the image surface against the rollers, conveyance guides, and the like, in the conveyance steps downstream of the ultraviolet light source 16, (2) rubbing between prints in the print stacking section, and (3) rubbing of a finished print against various objects when it is actually handled for use.

A mode is also possible in which another radiation source, such as an electron beam, is provided instead of the ultraviolet light source 16, and ink having properties which cause it to be hardened by the radiation source is used.

Furthermore, although the present embodiment describes a mode in which ultraviolet-curable ink is used and the ink is fixed on the recording paper 20 by the ultraviolet light source 16, it is also possible to use a heat source (heating device), such as a heater, or a cooling device, such as a cooling fan, as the ink fixing device, and if media (recording paper 20) having high permeability is used, then it is possible to use a device which promotes the permeation of the ink droplets into the media.

The print determination unit 18 is provided on the downstream side of the ultraviolet light source 16. The print determination unit 18 has an image sensor for capturing an image of the droplet ejection results of the print heads 12K, 12M, 12C, and 12Y, and functions as a device to check for ejection defects such as blocking of the nozzles on the basis of the printed image read in by the image sensor. The ejection determination includes detection of the presence of the ejection, measurement of the dot size, and measurement of the dot deposition position.

The print determination unit 18 of the present embodiment is configured with at least a line sensor having rows of photoelectric transducing elements with a width that is greater than the ink-droplet ejection width of the print heads 12K, 12M, 12C, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

In this way, the recording paper 20 (the created printed matter) that has passed under the ultraviolet light source 16 and the print determination unit 18 is outputted from the paper output unit 28 via nip rollers 47. Although not shown in FIG. 1, the paper output unit 28 is provided with a sorter for collecting images according to print orders.

Structure of Print Heads

Next, the structure of the print heads 12K, 12M, 12C, and 12Y shown in FIGS. 1 and 2 will be described. The print heads 12K, 12M, 12C, and 12Y provided for the respective ink colors have the same structure, and a reference numeral 50 is hereinafter designated to any of the print heads 12K, 12M, 12C, and 12Y.

Figure 3:
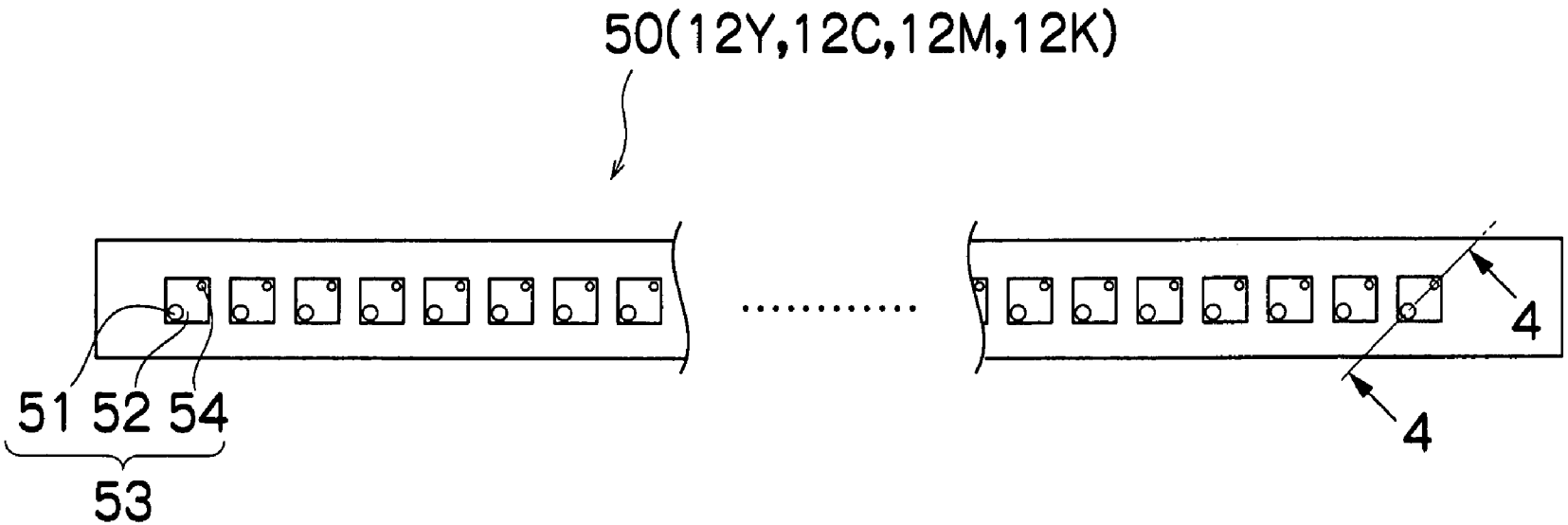
FIG. 3 is a plan view perspective diagram showing an example of the composition of a print head.
Figure 4:
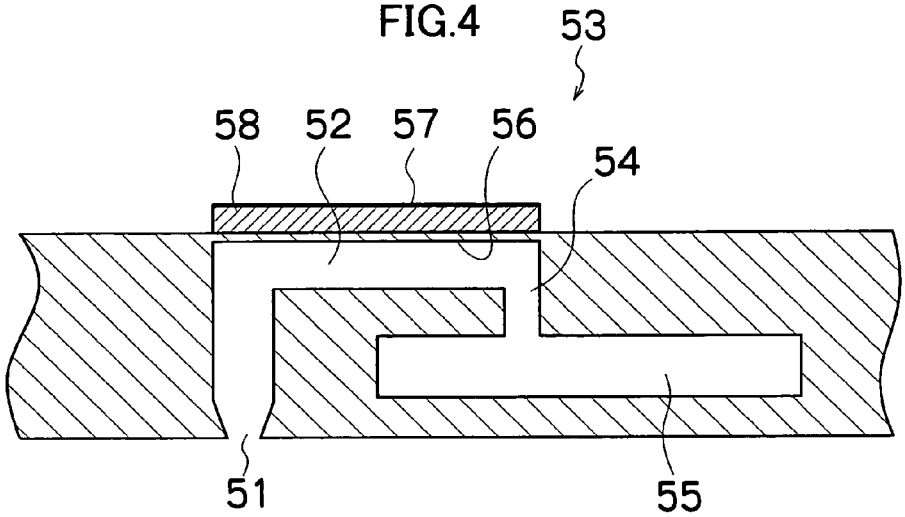
FIG. 4 is a cross-sectional diagram along section 4-4 in FIG. 3.

FIG. 3 is a plan view perspective diagram showing an example of the structure of a print head 50, and FIG. 4 is a cross-sectional diagram showing the three-dimensional composition of an ink chamber unit (a cross-sectional view along line 4-4 in FIG. 3).

As shown in FIGS. 3 and 4, the print head 50 according to the present embodiment has a structure in which a plurality of ink chamber units 53 each comprising nozzles 51 which eject ink droplets, pressure chambers 52 corresponding to the respective nozzles 51, and the like, are arranged in one row in the main scanning direction.

As shown in FIG. 3, the pressure chamber 52 provided corresponding to each of the nozzles 51 is approximately square-shaped in plan view, and a nozzle 51 and a supply port 54 are provided respectively at either corner on a diagonal of the pressure chamber 52. Each pressure chamber 52 is connected via a supply port 54 to a common flow channel 55.

An actuator 58 provided with an individual electrode 57 is joined to a pressure plate (diaphragm) 56 which forms the upper face of the pressure chamber 52, and the actuator 58 is deformed when a drive voltage is supplied to the individual electrode 57, thereby causing ink to be ejected from the nozzle 51. When ink is ejected, new ink is supplied to the pressure chamber 52 from the common flow pass channel 55, via the supply port 54.

In the present embodiment, the direction in which the plurality of nozzles 51 are arranged is the main scanning direction, and the direction perpendicular to this main scanning direction is the sub-scanning direction. In other words, the breadthways direction of the recording paper 20, which is the lengthwise direction of the print head 50, is the main scanning direction, and the paper conveyance direction, which is the movement direction of the recording paper 20, is the sub-scanning direction.

In the present embodiment, a full line type print head 50 having one row of nozzles in the main scanning direction is described, but the nozzle arrangement of the print head 50 is not limited to this and an arrangement comprising nozzles 51 arranged in a two-dimensional array may also be adopted.

Figure 5A:
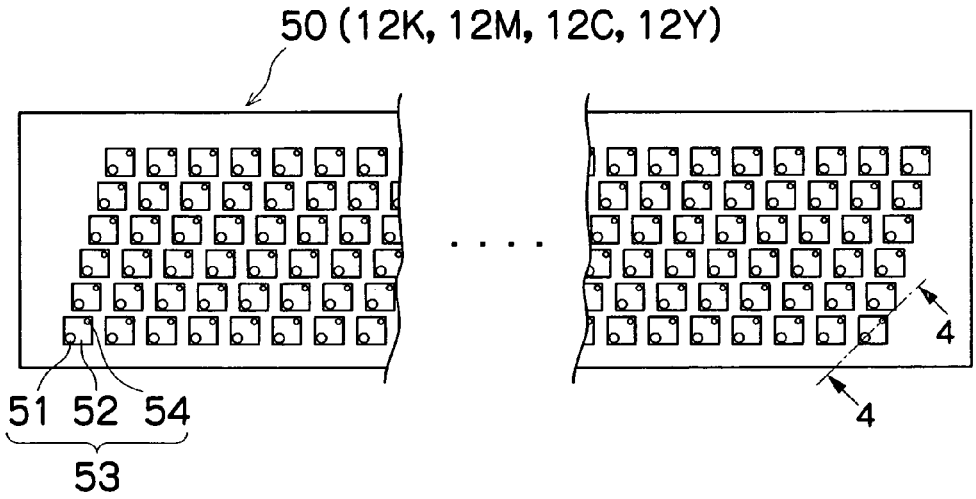
FIGS. 5A and 5B are plan view perspective diagrams showing a further example of the composition of a print head shown in FIG. 3.
Figure 5B:
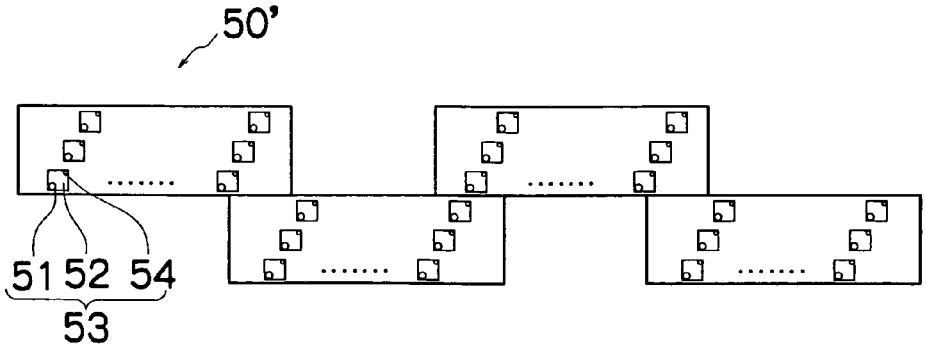

FIGS. 5A and 5B show examples of matrix arrangements in which the nozzles 51 are arranged in a two-dimensional array. In the print head 50 shown in FIG. 5A, the nozzle pitch is set to a high density in order to achieve a high density of the dot pitch printed onto the recording paper, and therefore it has a structure in which ink chamber units 53 having nozzles 51, pressure chambers 52 and the like are arranged in a staggered matrix array, thereby achieving a high density of the apparent nozzle pitch.

As shown in FIG. 5B, it is also possible to use print heads 50' of nozzles arranged to a short length in a two-dimensional fashion, and to combine same in a zigzag arrangement, whereby a length corresponding to the full width of the recording paper 20 is achieved.

Figure 6:
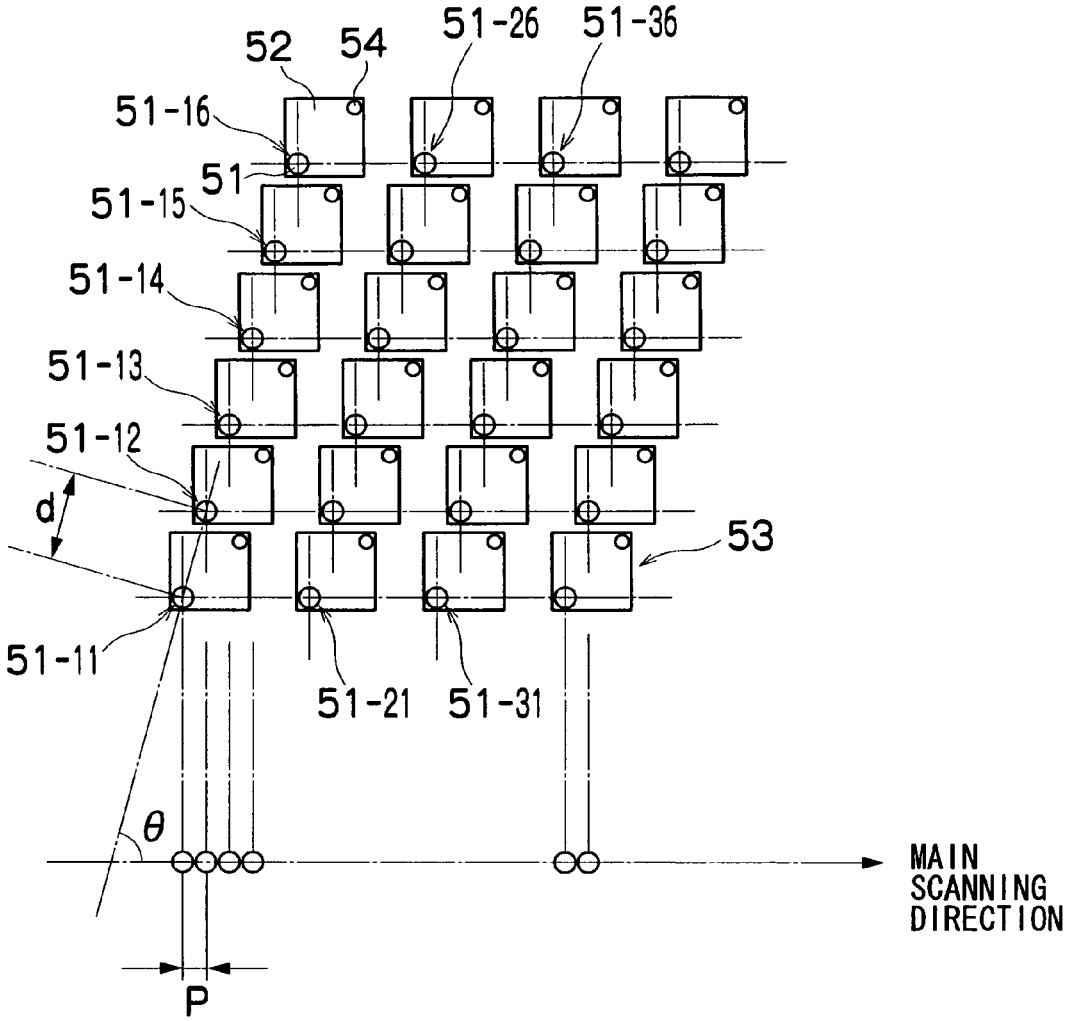
FIG. 6 is an enlarged view showing a nozzle arrangement in the print head shown in FIGS. 5A and 5B.

As shown in FIG. 6, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction will be $d \times \cos\theta$.

More specifically, the arrangement can be treated equivalently to one wherein the respective nozzles 51 are arranged in a linear fashion at uniform pitch P, in the main scanning direction. By adopting a composition of this kind, it is possible to achieve a nozzle configuration of high density.

When driving the nozzles 51 in a print head having the matrix structure described above, "main scanning" is defined as printing a line formed of a row of dots, or a line formed of a plurality of rows of dots in the breadthways direction of the recording paper 20 (the direction perpendicular to the conveyance direction of the recording paper 20) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIGS. 5A and 5B are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 20 by sequentially driving the nozzles 51-11, 51-12, . . . , 51-16 in accordance with the conveyance velocity of the recording paper 20.

On the other hand, "sub-scanning" is defined as to repeatedly perform printing of one line formed of a row of dots, or a line formed of a plurality of rows of dots formed by the main scanning, while moving the full-line head and the recording paper relatively to each other.

Furthermore, in implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Ink Supply System

Figure 7:
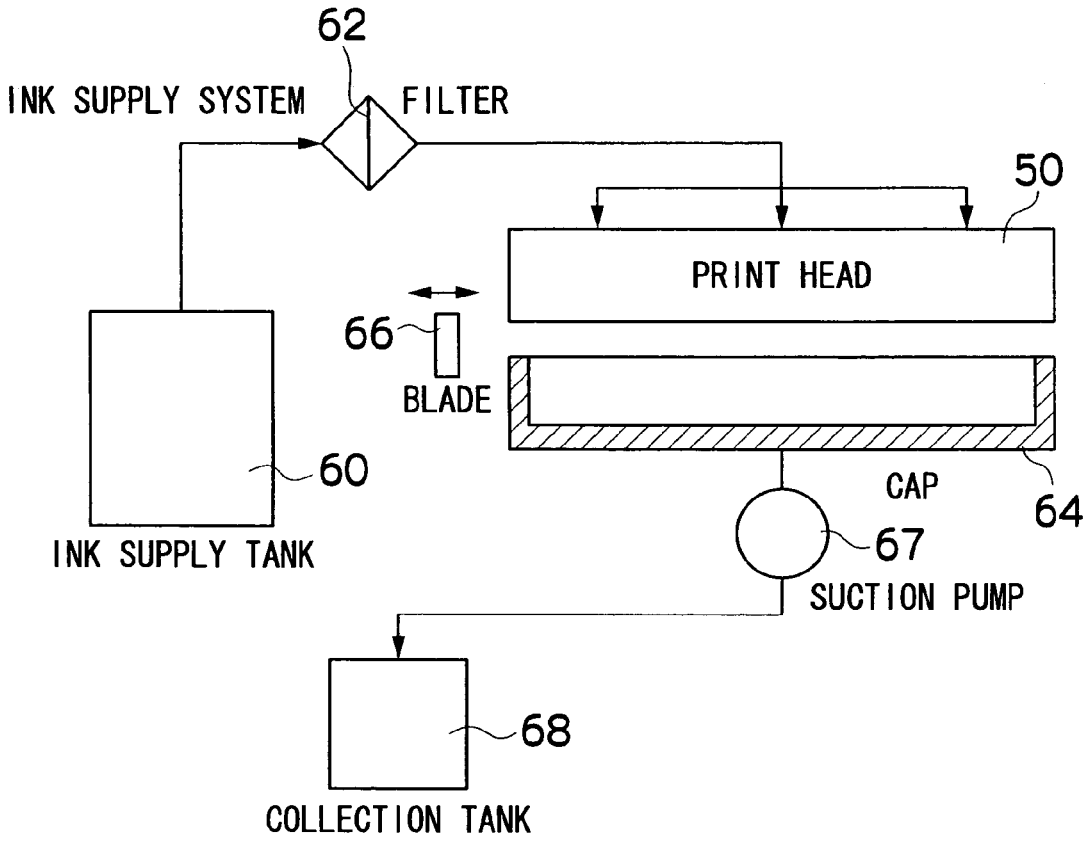
FIG. 7 is a conceptual diagram showing the composition of an ink supply system in an inkjet recording apparatus according to the present embodiment.

FIG. 7 is a schematic drawing showing the configuration of the ink supply system in the inkjet recording apparatus 10.

The ink supply tank 60 is a base tank to supply ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control and ink temperature control in accordance with the ink type. The ink supply tank 60 in FIG. 7 is equivalent to the ink storing and loading unit 14 in FIG. 1 described above.

A filter 62 for removing foreign matters and bubbles is disposed between the ink supply tank 60 and the print head 50 as shown in FIG. 7. The filter mesh size in the filter 62 is preferably equivalent to or less than the diameter of the nozzle and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face is thereby covered with the cap 64.

During printing or standby, if the use frequency of a particular nozzle 51 is low, and if it continues in a state of not ejecting ink for a prescribed time period or more, then the solvent of the ink in the vicinity of the nozzle evaporates and the viscosity of the ink increases. In a situation of this kind, it will become impossible to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection ("purge", "blank ejection", "liquid ejection" or "dummy ejection") is carried out in the direction of the cap 64 (ink receptacle), in order to expel the degraded ink (namely, the ink in the vicinity of the nozzle which has increased viscosity). In the inkjet recording apparatus 10, preliminary ejection is controlled in conjunction with the control of the ink temperature (details of which are described below).

Furthermore, if air bubbles enter into the ink inside the print head 50 (inside the pressure chamber 52), then even if the actuator 58 is operated, it will not be possible to eject ink from the nozzle. In a case of this kind, the cap 64 is placed on the print head 50, the ink (ink containing air bubbles) inside the pressure chamber 52 is removed by suction, by means of a suction pump 67, and the ink removed by suction is then sent to a collection tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chambers 52, the ink consumption is considerably large. Therefore, desirably, preliminary ejection is carried out while the increase in the viscosity of the ink is still minor.

The cleaning blade 66 is composed of rubber or another elastic member, and can slide on the ink ejection surface (surface of the nozzle plate) of the print head 50 by means of a blade movement mechanism (wiper) which is not shown. When ink droplets or foreign matter has adhered to the nozzle plate, the surface of the nozzle plate is wiped and cleaned by sliding the cleaning blade 66 on the nozzle plate. Preliminary injection is carried out to prevent foreign matters from entering the nozzle 51 by the blade when the ink ejection surface is cleaned by the blade mechanism.

Description of Control System

Figure 8:
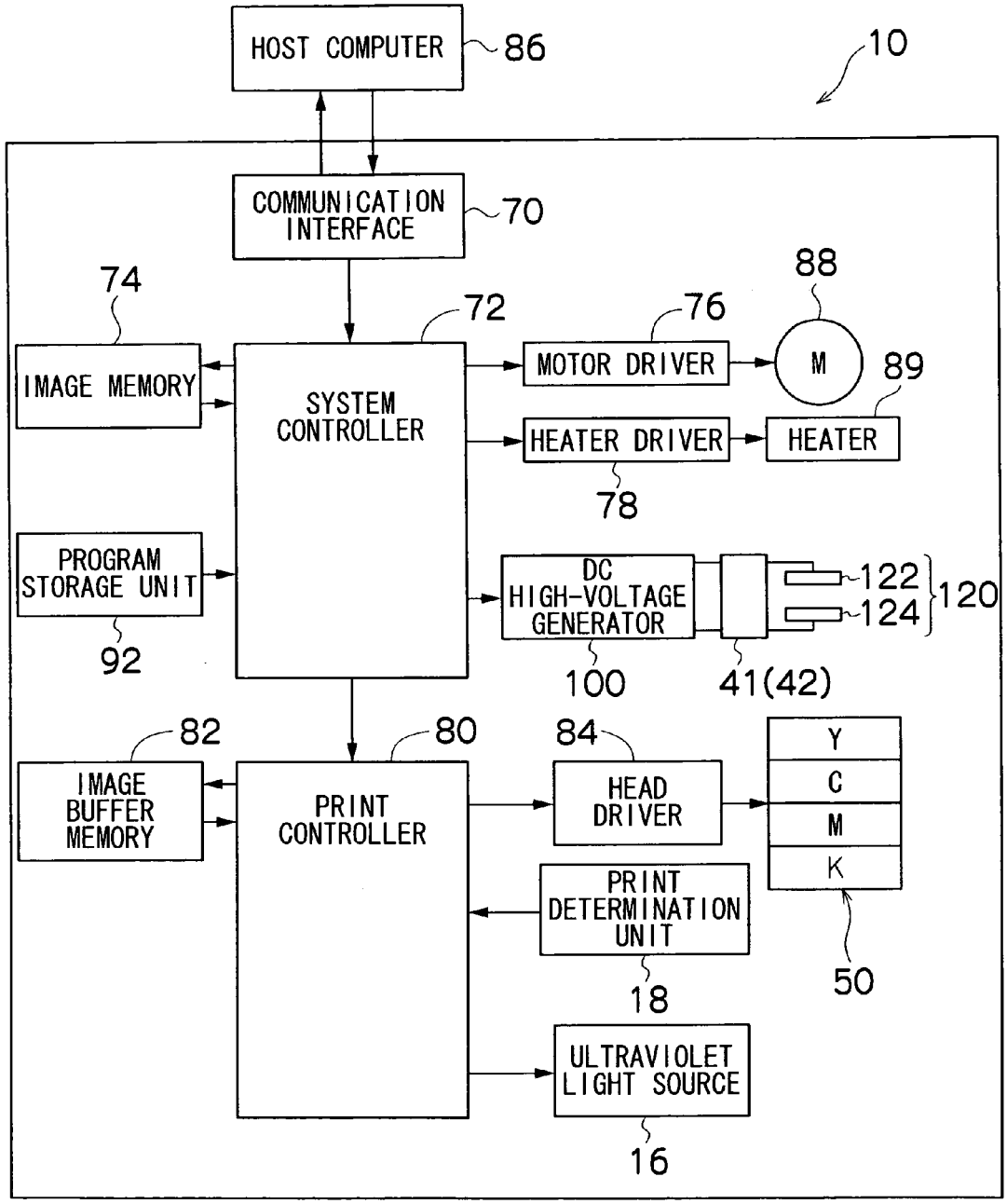
FIG. 8 is a principal block diagram showing the system configuration of the inkjet recording apparatus.

FIG. 8 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 drives the heater 89 of a post-drying unit or the like, which dries the recording paper 20 after printing, in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signals (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80.

FIG. 8 shows a mode in which the image buffer memory 82 is attached to the print controller 80; however, the memory 74 may also serve as the image buffer memory 82. Moreover, a mode is also possible in which the print controller 80 and the system controller 72 are integrated and constituted by a single processor. Of course, it is also possible to provide a recording device which records management data for the respective nozzles, separately from the image buffer memory 82.

The head driver 84 drives the actuators of the print heads of the respective colors 12K, 12C, 12M and 12Y on the basis of print data supplied by the print controller 80. The head driver 84 can be provided with a feedback control system for maintaining constant drive conditions for the print heads.

Various control programs are stored in a program storage unit 92, and a control program is read out and executed in accordance with commands from the system controller 72. Furthermore, when executing the program, the system parameters, operational parameters (set values), and the like, recorded in the memory 74 are read out occasionally.

The program storage unit 92 may use a semiconductor memory, such as a ROM, EEPROM, or a magnetic disk, or the like. An external interface may be provided, and a memory card or PC card may also be used. Naturally, a plurality of these storage media may also be provided.

The print determination unit 18 is a block that includes the line sensor as described above with reference to FIG. 1, reads the image printed on the recording paper 20, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 18.

Furthermore, FIG. 8 shows a mode in which a print controller 80 is provided separately from the system controller 72, but it is also possible to adopt a composition in which all or a portion of these are formed as a common processor (MPU, CPU), and all or a portion of the recording devices (storage devices), such as the memory 74 or image buffer memory 82, may be formed commonly.

The system controller 72 controls (the on/off operation, or the like, of) the DC high-voltage generator 100 and supplies a voltage to a first electrode group 120 provided in the belt-type electrode unit 43 shown in FIG. 1, via the roller 41 (and/or 42) in accordance with the print control or conveyance control of the recording paper 20.

A mode may be adopted in which the voltage is applied to the first electrode group 120 from the DC high-voltage generator 100 is variable, and this voltage is controlled by the system controller 72.

The print controller 80 controls the ultraviolet light source 16 which functions as an ink fixing device. This control includes controlling the on/off switching of the ultraviolet light source 16, controlling the amount of ultraviolet light (ultraviolet light intensity), the irradiation time period, and the like, in accordance with the type of recording paper 20.

Internal Structure of Belt-type Electrode Unit

Next, the internal structure of the belt-type electrode unit 43 shown in FIG. 1 will be described.

Figure 9:
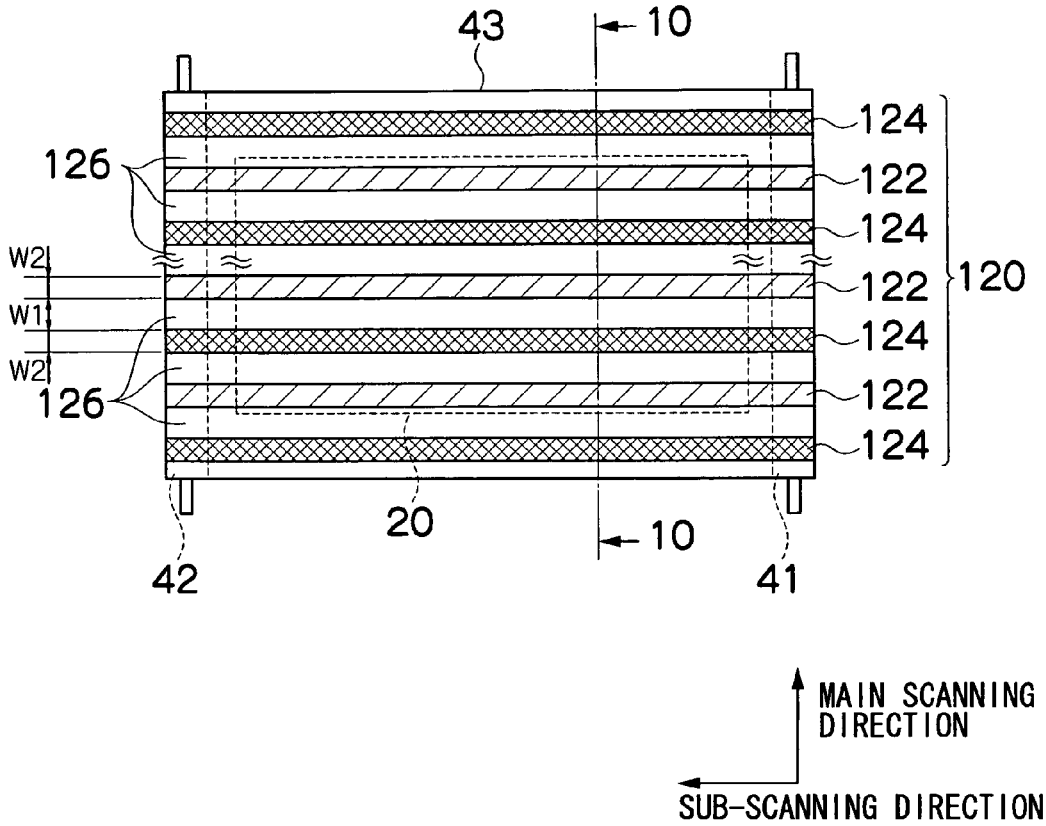
FIG. 9 is a plan view perspective diagram showing an example of the structure of a belt-type electrode unit according to a first embodiment.

FIG. 9 is a plan view perspective diagram of the belt-type electrode unit 43. The belt-type electrode unit 43 is formed to a broader width than the recording paper 20, in such a manner that it can be attracted reliably to the recording paper 20 indicated by the broken lines in FIG. 9.

The belt-type electrode unit 43 has a structure in which a first electrode group 120 having a lengthwise direction coinciding with the sub-scanning direction has electrodes aligned with the main scanning direction at equidistant intervals, the first electrode group 120 being disposed directly below the recording paper 20. Furthermore, the first electrode group 120 has a structure in which positive electrodes 122 and negative electrodes 124 are arranged alternately, and non-conducting members 126 are provided between the positive electrodes 122 and the negative electrodes 124 in order to ensure insulating properties between the positive electrodes 122 and the negative electrodes 124.

The length of the first electrode group 120 in the sub-scanning direction is equal to or greater than the length of the printable range of the recording paper 20 in the sub-scanning direction (the paper conveyance direction), and it may be a length which spans the entire length of the belt-type electrode unit 43 in the sub-scanning direction. Furthermore, the first electrode group 120 may also have a split structure which is split in the sub-scanning direction.

The electrical potentials of the positive electrodes and the negative electrodes have a relationship whereby the positive electrodes have a higher electrical potential than the negative electrodes. More specifically, it is enough that the potential difference (voltage) between the positive electrodes and the negative electrodes causes the ink droplets to display electrorheological properties, and the potentials of the positive electrodes and the negative electrodes may be both positive or both negative. Of course, it is possible that one of these potentials is 0V (i.e., grounded).

Furthermore, the positive electrodes 122 and the negative electrodes 124 provided on the belt-type electrode unit 43 may be provided in the same number or they may be provided in different numbers. One of either the positive electrodes 122 or the negative electrodes 124 may be provided as one electrode only, while the other is provided as a plurality of electrodes. If there is a difference between the number of positive electrodes 122 and the number of negative electrodes 124, then a disparity occurs in the electrodes formed between the two types of electrodes, and therefore, it is desirable that the number of positive electrodes 122 and the number of negative electrodes 124 are equal to each other.

Figure 10:
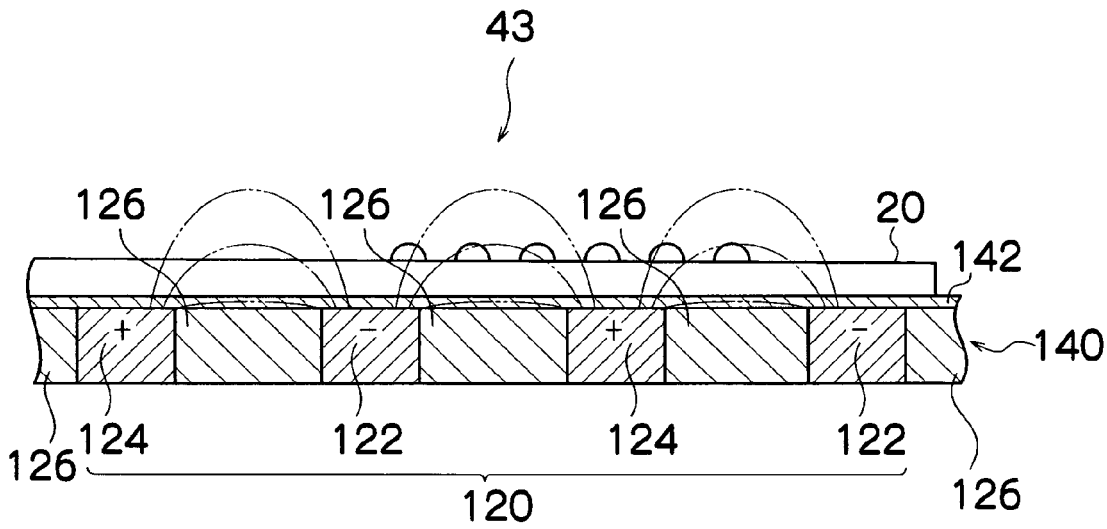
FIG. 10 is a cross-sectional diagram along section 10-10 in FIG. 9.

FIG. 10 is a cross-sectional diagram showing the three-dimensional structure of the belt-type electrode unit 43 shown in FIG. 9 (namely, a cross-sectional diagram along line 10-10 in FIG. 9).

As shown in FIG. 10, the belt-type electrode unit 43 has a structure including two layers, wherein an electrode layer 140 formed with the first electrode group 120 (the positive electrodes 122 and the negative electrodes 124) shown in FIG. 9 is provided, and a minimally conductive layer 142 is laminated onto the upper side of the electrode layer 140.

In other words, in the belt-type electrode unit 43, the minimally conductive layer 142 is provided on the uppermost layer which makes contact with the recording paper 20, and the electrode layer 140, in which the first electrode group 120 and the non-conducting members 126 are formed, is provided on the surface of the minimally conductive layer 142 opposite to the side on which the recording paper 20 is placed.

Figure 11:
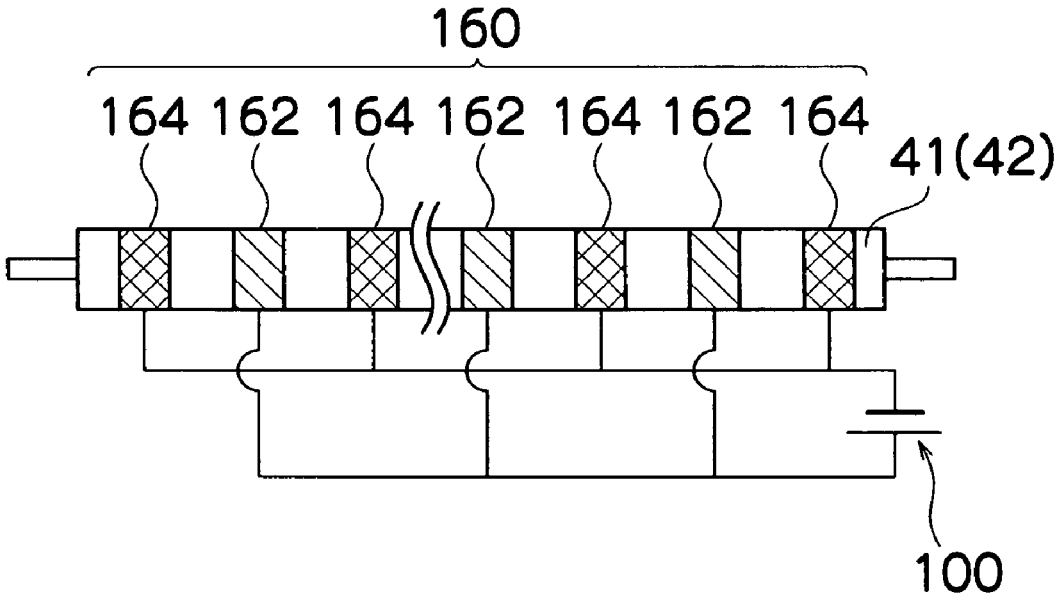
FIG. 11 is a plan diagram showing an example of the composition of the roller according to the first embodiment.

The surface of the electrode layer 140 which makes contact with the rollers 41 and 42 has a structure in which the first electrode group 120 is exposed, and by means of the first electrode group 120 making contact with a power supply section 160 shown in FIG. 11 provided on the face (outer surface) of the roller 41 (and/or 42) which contacts the belt-type electrode unit 43, the first electrode group 120 is able to receive a supply of voltage from the DC high-voltage generator 100.

The DC high-voltage generator 100 forming the voltage supply and the rollers 41 and 42 which function as voltage application devices for applying voltage supplied from the DC high-voltage generator 100 to the belt-type electrode unit 43 (first electrode group 120) also serve as voltage application devices for a static electricity generating section which holds the recording paper 20 onto the belt-type electrode unit 43 by means of electrostatic attraction.

Furthermore, the power supply section 160 comprises positive electrodes 162 which make contact with and form an electrical connection with the positive electrodes 122, and negative electrodes 164 which make contact with and form an electrical connection with the negative electrodes 124.

If the DC high-voltage generator 100 is built into the roller 41 (and/or 42), then it is possible to simplify the wiring structure between the DC high-voltage generator 100 and the power supply section 160, and to shorten the wiring length, and thus not only it is possible to prevent dangers to human operators, such as electrical shocks, but furthermore, radiation noise emitted by the wiring can be restricted.

When a prescribed voltage is applied from the DC high-voltage generator 100 to the positive and negative electrodes 122 and 124, substantially arc-shaped lines of electric force (indicated by the double-dotted lines in FIG. 10) are formed, linking the mutually adjacent positive electrodes 122 and negative electrodes 124.

The minimally conductive layer 142 provided on the side of the electrode layer 140 adjacent to the recording paper 20 is a thin layer having very weak conductive properties. Therefore, when a prescribed voltage is applied to the positive and negative electrodes 122 and 124 from the DC high-voltage generator 100, a very weak current flows in the ink droplets deposited on the recording paper 20.

In other words, when a prescribed voltage is applied to the positive and negative electrodes 122 and 124, an electric field is applied to the ink droplets deposited on the recording paper 20, and furthermore, a very weak current flows in the deposited ink droplets, via the weak conductive layer 142. These actions are suitable for increasing the viscosity of the deposited ink droplets which have electrorheological properties, and consequently, deposition interference, such as combination of the ink droplets, bleeding during permeation, or color mixing, can be prevented.

Furthermore, since the electrode layer 140 can be positioned in the vicinity of the deposited ink droplets, without making direct contact with the deposited ink droplets on the recording paper 20, then it is possible to apply a stronger electric field to the recording paper 20. Moreover, it is also possible to ensure that the clearance between the print heads 12K, 12M, 12C and 12Y, and the recording paper 20, remains uniform.

In other words, an electric field is generated above the first electrode group 120 (on the side by the recording paper 20), in such a manner that it spans between the adjacent electrodes of the first electrode group 120 (the mutually adjacent positive and negative electrodes 122 and 124), thereby applying an electric field to the recording paper 20 and to the actual ink droplets deposited on the recording paper 20, and therefore, the ink droplets deposited on the recording paper 20 can reliably be made to display electrorheological properties.

Furthermore, it is known experimentally that ink droplets display electrorheological properties in the direction of the electric field applied to the ink droplets (in other words, the viscosity of the ink droplets increases in the direction in which the electric field is applied), and therefore, by aligning the direction of application of the electric field with the lengthwise direction of the print head 50 (namely, generating an electric field in the main scanning direction), it is possible to increase the viscosity of the ink droplets in the main scanning direction, and hence a system can be achieved which is highly effective with respect to banding in the main scanning direction (banding which extends in the sub-scanning direction).

In the present embodiment, desirably, the electrical resistivity of the minimally conductive layer 142 is $10^8$ ohm·cm to $10^{12}$ ohm·cm. Furthermore, desirably, the thickness of the minimally conductive layer 142 is approximately 0.01 mm to 1 mm.

Moreover, since the minimally conductive layer 142 has very weak conductive properties, as described above, this prevents the electrode layer 140 from remaining in a charged state when no printing operation is being carried out, for instance, when the power supply is switched off. Since the minimally conductive layer 142 covers the surface of the electrode layer 140 adjacent to the recording paper 20, it serves to prevent human injury resulting from electrical shock, or the like, as well as protecting the positive and negative electrodes 122 and 124.

The intensity of the electric field applied to the recording paper 20 is. inversely proportional to the pitch W1 (see FIG. 9) between the positive electrodes 122 and the negative electrodes 124 disposed adjacently in the main scanning direction. In other words, if the voltage applied to the DC high-voltage generator 100 is constant, then the smaller the value of the electrode pitch W1, the intensity of the electric field on the recording paper 20 is greater.

Therefore, it is preferable that the electrode pitch W1 is small, and more desirably, it is approximately 0.1 mm to 2 mm.

The present embodiment shows a mode in which the pitch between the electrodes is uniform, but it is also possible to position the electrodes in such a manner that the pitch between the electrodes varies.

Furthermore, the narrower the electrode width W2 of the electrodes 122 and 124, the more uniform the strength of the electric field generated on the recording paper 20, and the greater the electrorheological effects in the ink droplets deposited on the recording paper 20. If the width W2 of the electrodes 122 and 124 is large, then the vertical component of the lines of electric force in the generated electric field, which is oriented in the upward direction in FIG. 10, increases, and it is not possible to obtain a sufficient electrorheological effect in the ink droplets deposited on the recording paper 20.

Therefore, it is desirable for the electrode width W2 to be narrow, and needle-shaped electrodes, or the like, are preferably used. The electrode width is preferably 0.01 mm to 1 mm.

The present embodiment shows a mode in which electrodes of uniform length are provided in the belt-type electrode unit 43, but it is also possible to provide electrodes of different widths in the belt-type electrode unit 43.

When the intensity of the electric field applied to the recording paper 20 lies within the range of 0.1 kV/mm to 10 kV/mm, a large electrorheological effect is obtained with respect to the ink droplets deposited on the recording paper 20. Therefore, desirably, the voltage applied by the DC high-voltage generator 100 is controlled in such a manner that the intensity of the electric field applied to the recording paper 20 lies in the range of 0.1 kV/mm to 10 kV/mm. An applied voltage which creates an electric field intensity in the range of 0.1 kV/mm to 10 kV/mm is one of several kV to several tens kV.

In the inkjet recording apparatus 10 having the composition described above, the first electrode group 120 having the positive and negative electrodes 122 and 124 is provided directly below the recording paper 20, and an electric field generated by the first electrode group 120 is applied to the recording paper 20 and the actual ink deposited on the recording paper 20. Therefore, it is possible reliably to make the ink droplets deposited on the recording paper 20 display electrorheological properties.

Furthermore, since the first electrode group 120 is disposed in such a manner that the direction of the electric field generated by the first electrode group 120 coincides with the lengthwise direction of the print head 50, then it is possible to achieve a system which is highly effective with respect to banding in the main scanning direction of an image formed in the recording paper 20.

Second Embodiment

Structure of Belt-Type Electrode Unit

Next, a second embodiment of the present invention will be described. In the diagram illustrating the second embodiment, those parts which are the same or similar to those in the diagram illustrating the first embodiment are labeled with the same reference numerals, and description thereof is omitted.

Figure 12:
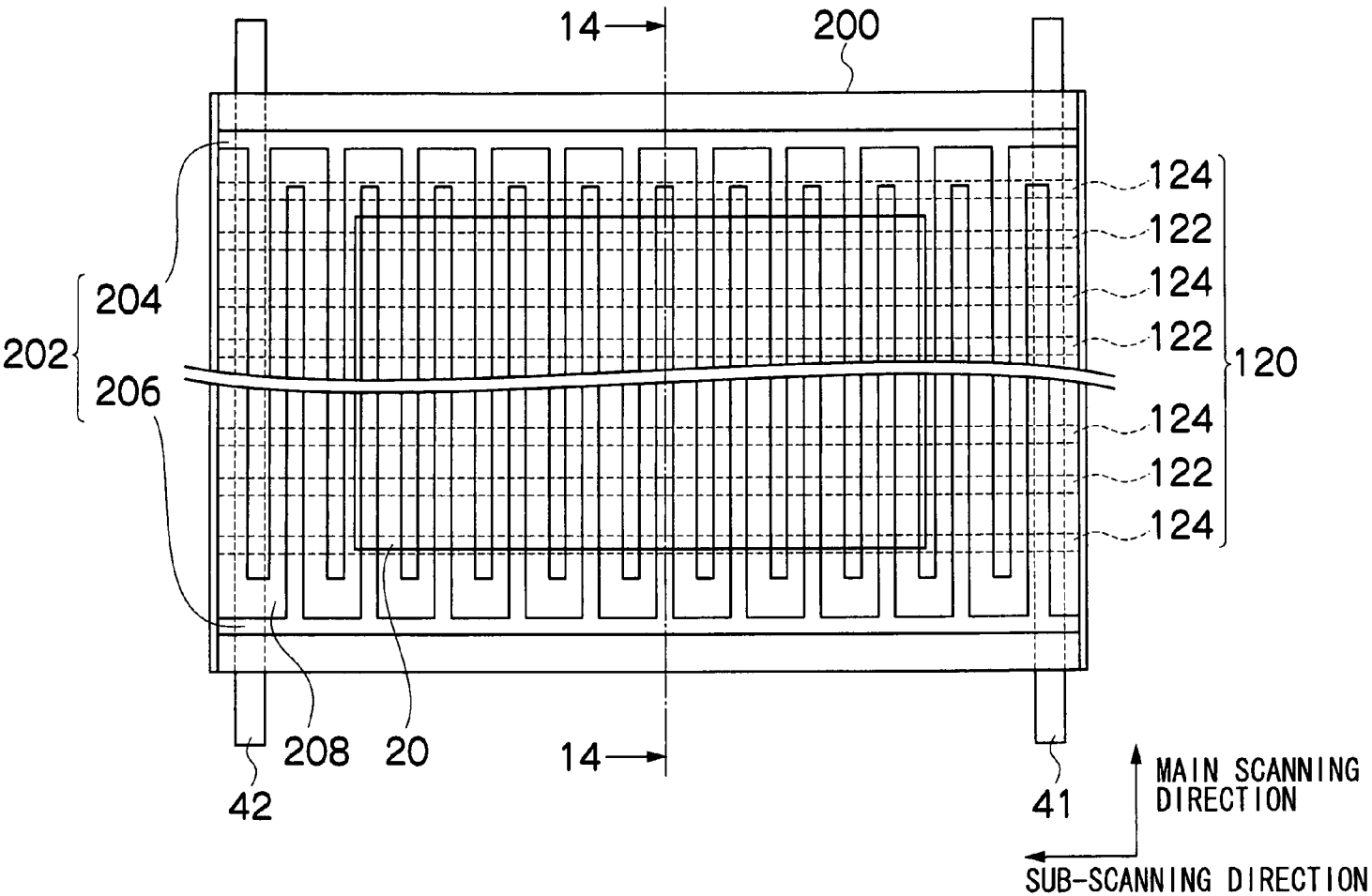
FIG. 12 is a plan view perspective diagram showing an example of the structure of a belt-type electrode unit according to a second embodiment.

FIG. 12 is a plan view perspective diagram showing the structure of a belt-type electrode unit 200 according to the second embodiment. The belt type electrode unit 200 comprises, in addition to the composition of the belt-type electrode unit 43 according to the first embodiment, a second electrode group 202 having a comb-shaped section in the main scanning direction, which is substantially perpendicular to the first electrode group 120.

When a prescribed voltage is applied to the second electrode group 202 by the DC high-voltage generator 100, an electric field is formed in a direction substantially parallel to the sub-scanning direction, and the ink droplets deposited onto the recording paper 20 display electrorheological properties in such a manner that the viscosity increases in the sub-scanning direction.

In other words, the belt-type electrode unit 200 comprises electrodes disposed in two perpendicular directions in a first electrode group 120 which is parallel to the sub-scanning direction, which coincides with the conveyance direction of the recording paper 20, and a second electrode group 202 which is substantially perpendicular to the first electrode group 120 (i.e., parallel to the main scanning direction), in such a manner that it can switch between generating an electric field from either of the electrode groups in accordance with the print method (image forming method).

Figure 13:
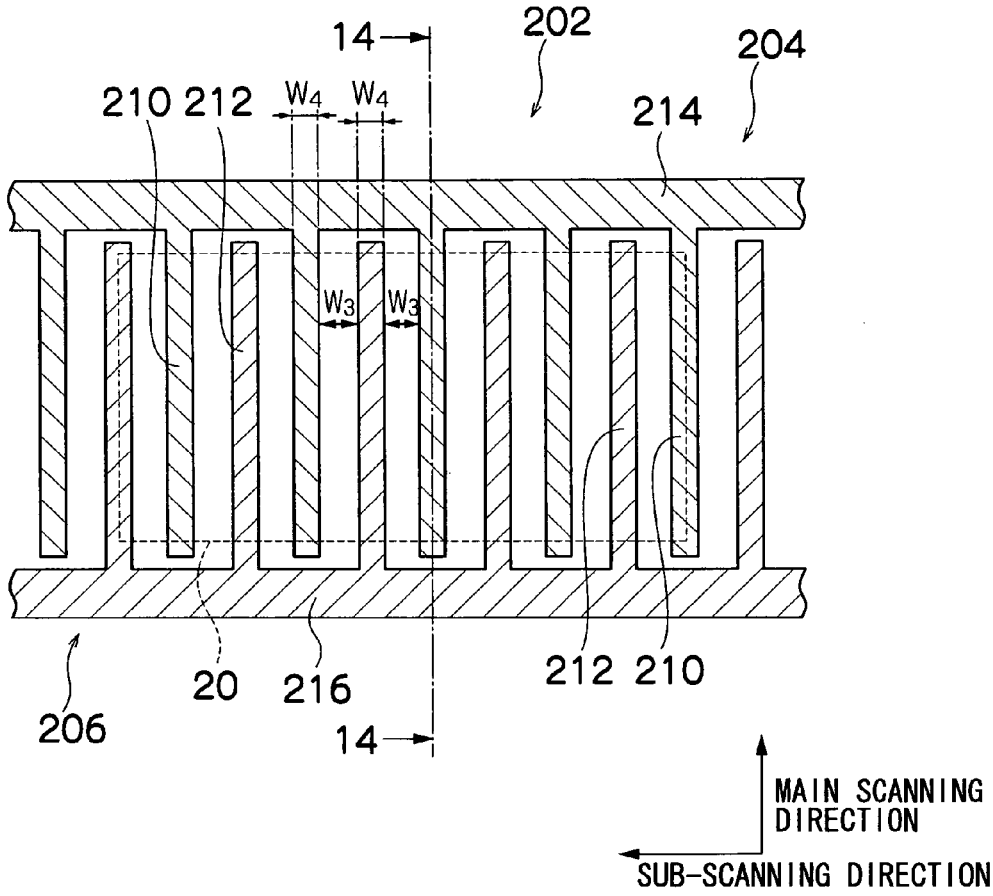
FIG. 13 is a plan diagram showing an example of the composition of a second electrode group.

Furthermore, as shown in FIGS. 12 and 13, the second electrode group 202 is constituted by a positive electrode 204 and a negative electrode 206, and the positive electrode 204 and the negative electrode 206 are comb-shaped electrodes respectively having a plurality of comb tooth sections 210 and 212 which are substantially parallel with the main scanning direction. Non-conducting members 208 are provided between the positive electrodes 204 and the negative electrodes 206, and the non-conducting members 208 may be formed by the same members as the non-conducting members 126 shown in FIG. 10, or they may be different members.

Furthermore, the second electrode group 202 has a structure in which the comb tooth sections (positive tooth sections) 210 of the positive electrode 204 and the comb tooth sections (negative tooth sections) 212 of the negative electrode 206 are arranged alternately in the sub-scanning direction.

The positive comb tooth sections 210 are linked by a common electrode section 214, which is parallel to the sub-scanning direction, and the common electrode section 214 has a structure whereby it is positioned to the outer side of the region corresponding to the area where the first electrode group 120 is formed.

On the other hand, the negative comb tooth sections 212 are linked by a common electrode section 216, which is parallel to he sub-scanning direction, and the common electrode section 216 has a structure whereby it is positioned to the outer side of the region corresponding to the area where the first electrode group 120 is formed, on the opposite side from the common electrode section 214.

Similarly to the first electrode group 120 shown in FIG. 9, the electrode pitch W3 in the positive comb tooth section 210 and the negative comb tooth section 212 is approximately 0.1 to 2 mm, and the electrode width W4 of the respective comb tooth sections 210 and 212 is approximately 0.01 mm to 1 mm.

On the other hand, the second electrode group 202 is supplied with a prescribed voltage (several kV to several tens kV) by the DC high-voltage generator 100 shown in FIG. 9, and it is able to generate an electric field in the range of 0.1 kV/mm to 10 kV/mm, which produces a large electrorheological effect in the ink droplets on the recording paper 20.

Figure 14:
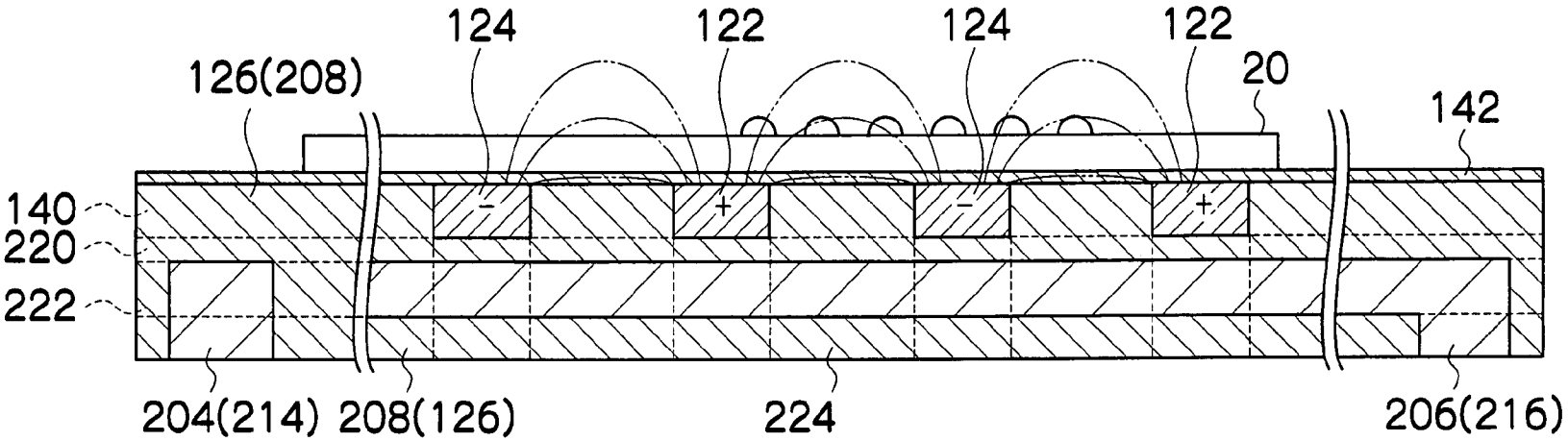
FIG. 14 is a cross-sectional diagram along section 14-14 in FIG. 12.

Next, the three-dimensional structure of the belt-type electrode unit 200 will be described. FIG. 14 is a cross-sectional diagram showing the three-dimensional structure of the belt-type electrode unit 200 (a cross-sectional diagram along line 14-14 in FIGS. 12 and 13).

The belt-type electrode unit 200 shown in FIG. 14 has a structure where a layer in which the second electrode group 202 is formed is added to the bottommost layer of the belt-type electrode unit 43 shown in FIG. 10.

More specifically, as shown in FIG. 14, the belt-type electrode unit 200 has a laminated structure including the following four layers, which are laminated in this order from the top down: a minimally conductive layer 142 shown in FIG. 10, which is provided in the uppermost layer which makes contact with the recording paper 20; a first electrode layer 140, in which the first electrode group 120 shown in FIG. 10 is formed, provided on the opposite side of the minimally conductive layer 142 with respect to the surface which makes contact with the recording paper 20; a non-conducting layer 220 comprising non-conducting members (namely, the members indicated by reference numeral 126 in FIG. 10 and the members indicated by reference numeral 208 in FIG. 12), provided on the opposite side of the first electrode layer 140 from the minimally conductive layer 142; and a second electrode layer 222, in which the second electrode group 202 shown in FIGS. 11 and 12 is formed, provided on the opposite side of the non-conducting layer 220 from the first electrode layer 140.

Furthermore, a portion of the first electrode group 120 is composed in such a manner that does not pass through (namely, avoids) the region where the second electrode group 202 is formed and pierces through the non-conducting layer 220 and the second electrode layer 222, while maintaining a prescribed insulating distance from the second electrode group 202. A portion of the first electrode group 120 is exposed at the surface of the second electrode layer 222 on the opposite side from the non-conducting layer 220.

On the other hand, the second electrode layer 222 has a supporting member 224 provided on the under side of the second electrode group 202 and the comb tooth sections 210 and 212 of the second electrode group 202, and the surface of the second electrode layer 222 on the opposite side from the non-conducting layer 220 has a structure whereby the common electrode sections 214 and 216 of the positive and negative electrodes 204 and 206 are exposed.

Figure 15:
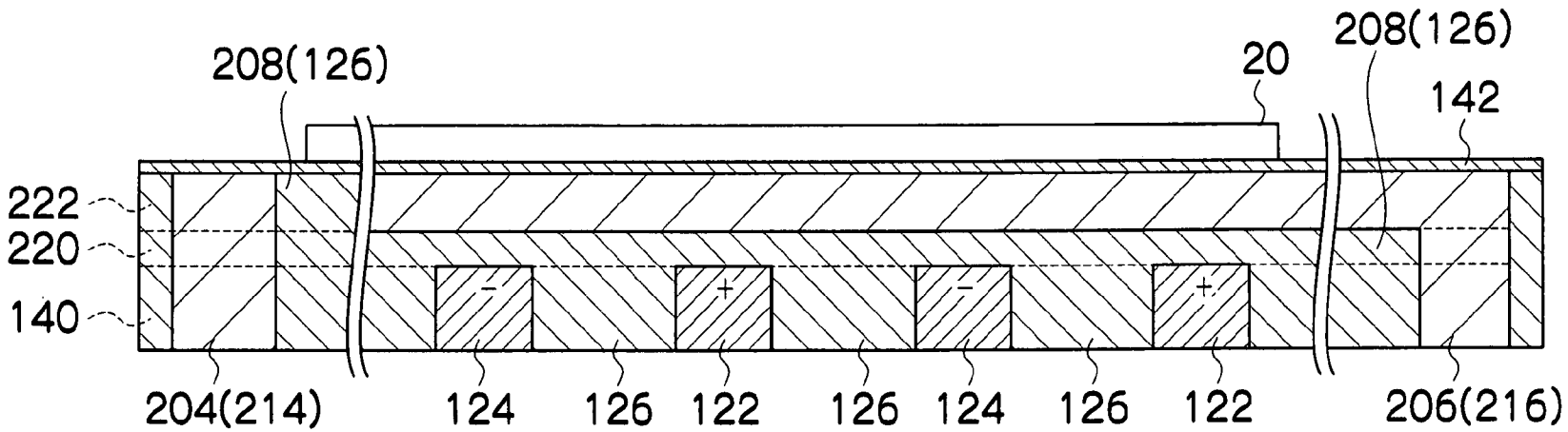
FIG. 15 is a cross-sectional diagram showing a further mode of the belt type electrode unit shown in FIG. 14.

As shown in FIG. 15, it is also possible to adopt a composition in which the first electrode layer 140 and the second electrode layer 222 are interchanged.

Figure 16:
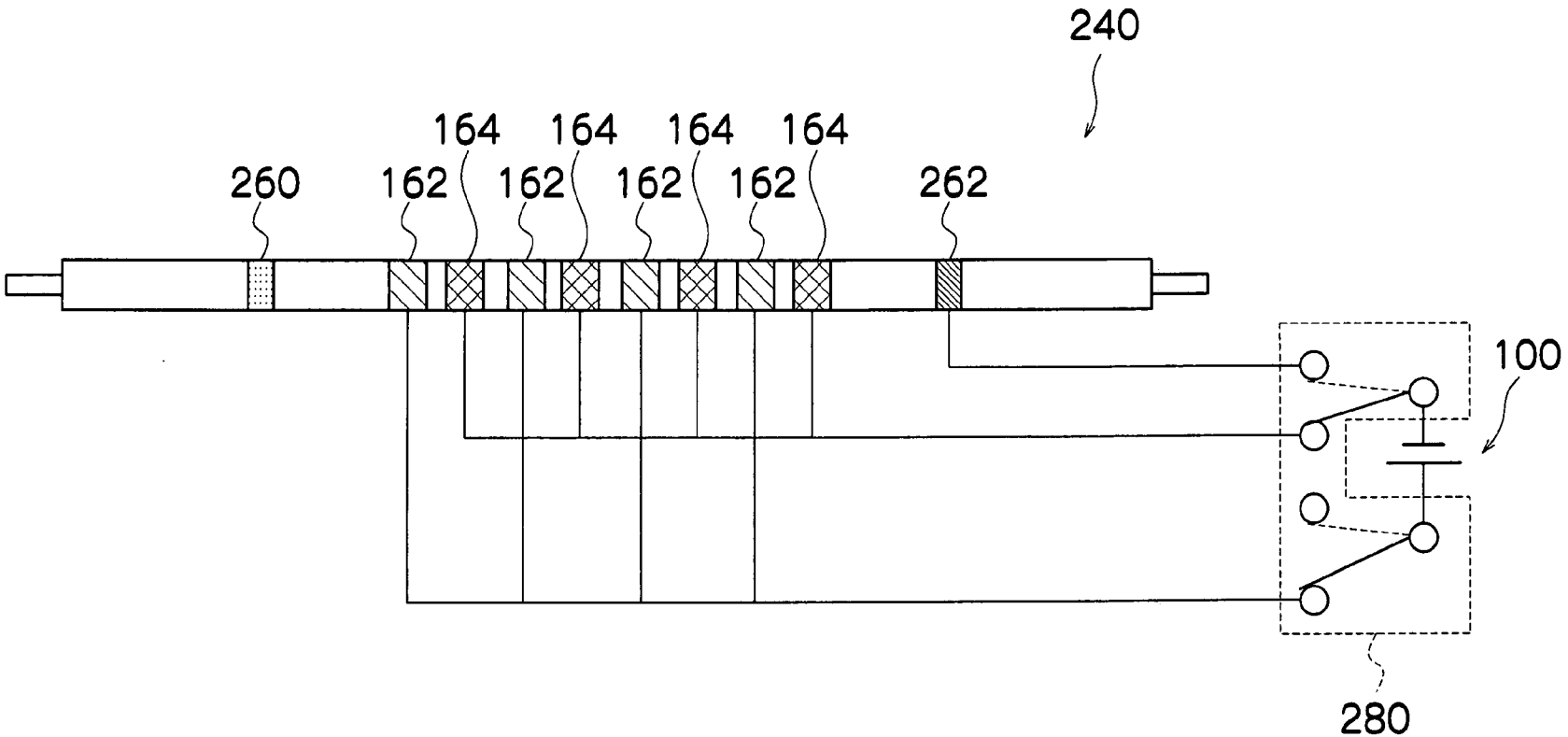
FIG. 16 is a plan diagram showing an example of the composition of a roller according to the second embodiment.

FIG. 16 shows a roller 240 about which the belt-type electrode unit 200 is wound. The roller 240 shown in FIG. 16 comprises, in addition to the composition of the roller 41 shown in FIG. 11, second power supply sections 260 and 262 which supply a prescribed voltage from the DC high-voltage generator 100 to the second electrode group 202 by making contact with the common electrode sections 214 and 216 of the second electrode group 202.

In the present embodiment, a switch unit 280 which is controlled by the system controller 72 shown in FIG. 8 is provided in the wiring from the DC high-voltage generator 100 to the respective power supply sections 260 and 262 of the roller 240, and therefore, under the control of the system controller 72, it is possible to switch between supplying voltage to the first electrode group 120 and supplying voltage to the second electrode group 202, from the DC high-voltage generator 100.

More specifically, if a circuit is formed by controlling the switching unit 280 as illustrated by the solid lines, then a prescribed voltage is supplied from the DC high-voltage generator 100 to the first electrode group 120. On the other hand, if a circuit is formed as indicated by the broken lines, then the prescribed voltage is supplied from the DC high-voltage generator 100 to the second electrode group 202. The switching unit 280 may also be incorporated into the DC high-voltage generator 100.

The present embodiment shows a mode in which voltage is supplied from a voltage supply source (DC high-voltage generator 100) to the first electrode group 120 or the second electrode group 202, but it is also possible to separately provide a voltage supply which supplies voltage to the first electrode group 120 and another voltage supply which supplies voltage to the second electrode group 202.

Furthermore, a desirable mode is one in which the switch unit 280 is composed (or controlled) in such a manner that voltage cannot be simultaneously supplied to both the first electrode group 120 and the second electrode group 202.

Description of Electric Field Switching Control

Next, the switching control of the direction in which the electric field is generated, as performed by the switching unit 280 shown in FIG. 16, will be described in detail.

In this inkjet recording apparatus 10, the switching of the switch unit 280 is controlled in such a manner that it switches between the first electrode group 120 and the second electrode group 202, and thus switches between applying an electric field in the main scanning direction and applying an electric field in the sub-scanning direction, to the ink droplets on the recording paper 20, in accordance with the type of recording paper 20 (media type), the image data, and the like.

By switching the direction of the electric field applied to the ink droplets in this way, it is possible to impart directionality to the increase in the viscosity of the ink droplets due to the electrorheological effects that the ink is caused to display.

Next, a concrete example of switching control of the electric field direction in the present embodiment will be described.

When an ink droplet has been deposited from a certain nozzle, then if another ink droplet is deposited from an adjacent nozzle in the main scanning direction (namely, a nozzle which ejects ink droplets onto a landing position which is adjacent in the main scanning direction to the landing position of the previously deposited ink droplet), before the former ink droplet has completed fixing or permeation after landing on the recording paper 20 (in other words, before fixing or permeation has progressed to a level which prevents interference with other ink droplets), then if the two ink droplets have sizes which cause them to overlap (or at least make contact), deposition interference will arise between the ink droplets, and positional divergence of the ink droplets and the like caused by aggregation in the main scanning direction is liable to occur.

In this case, when an electric field is generated by the first electrode group 120, the viscosity of the ink droplets increases in the main scanning direction, and it is therefore possible to suppress aggregation in the main scanning direction.

On the other hand, in cases where no deposition interference occurs between two ink droplets, even if an ink droplet is deposited from a particular nozzle and then an ink droplet is deposited from an adjacent nozzle in the main scanning direction, before the former ink droplet has completed fixing or permeation after landing on the recording paper 20, then positional displacement of the ink droplets and the like will not occur due to aggregation in the main scanning direction.

In this situation, if there is a possibility that aggregation may occur in the sub-scanning direction between ink droplets deposited from the same nozzle, when a plurality of ink droplets are deposited from one nozzle and then ink droplets are deposited from different nozzles, then it is possible to prevent positional displacement of the ink droplets due to aggregation in the sub-scanning direction by increasing the viscosity of the ink droplets in the sub-scanning direction through generating an electric field from the second electrode group 202.

Furthermore, the direction of generation of the electric field can be switched and controlled in accordance with the fixing properties and permeation properties of the ink, in such a manner that, when using a media type having relatively slow fixing or permeation characteristics with respect to the ink droplets, an electric field is generated by the first electrode group 120, and when using a media type having relatively fast ink fixing or permeation characteristics, an electric field is generated by the second electrode group 202.

In a print head (matrix head) having nozzles arranged in a matrix fashion, as shown in FIGS. 5A and 5B, the nozzles having the shortest pitch in the main scanning direction (nozzles which eject ink droplets onto landing positions which are adjacent in the main scanning direction) are disposed a prescribed distance apart in the sub-scanning direction.

If the conveyance speed of the recording paper 20 is high, as in normal mode printing, then ink droplets are deposited onto adjacent landing positions in the main scanning direction without waiting for previously deposited ink droplets to permeate or become fixed, and therefore, aggregation in the main scanning direction may occur. Consequently, the switching of the switch unit 280 shown in FIG. 16 is controlled in such a manner that an electric field is generated in the main scanning direction by using the first electrode group 120 and therefore, the viscosity of the ink droplets is increased in the main scanning direction.

For example, as shown in FIG. 7, if printing at a resolution of 2400 dpi×2400 dpi using a print head 50 having nozzles 51 arranged in a matrix array, then nozzles which eject ink droplets to form mutually adjacent dots in the main scanning direction (for instance, nozzle 51-11 and nozzle 51-12 in FIG. 17) are separated by a pitch of Ps=0.5 mm in the sub-scanning direction, and supposing that the ink permeation time (time from landing of the ink on the recording paper 20 until permeation of the ink into the recording paper 20) is T=10 msec, then in a normal mode having an ejection frequency of f=38 kHz and recording paper 20 conveyance speed of V=400 mm/sec, the ejection interval between ejection of ink droplets which are mutually adjacent in the main scanning direction (the ejection interval in the main scanning direction) $\Delta t$ will be $\Delta t = Ps/V = 1.25$ msec.

Here, the permeation time T and the ejection interval $\Delta t$ in the main scanning direction have the relationship of $T \geqq \Delta t$.

In other words, in the ink droplets forming dots which are mutually adjacent in the main scanning direction, a subsequent ink droplet lands before the previously deposited ink droplet has permeated into the medium.

On the other hand, if the conveyance speed of the recording paper 20 is slow, as in high-quality mode printing, then aggregation may occur between ink droplets which are mutually adjacent in the sub-scanning direction and which are deposited by the same nozzle. Therefore, the switching of the switch unit 280 shown in FIG. 16 is controlled in such a manner that an electric field is generated in the sub-scanning direction, using the second electrode group 202, and the viscosity of the ink droplets is increased in the sub-scanning direction.

Figure 17:
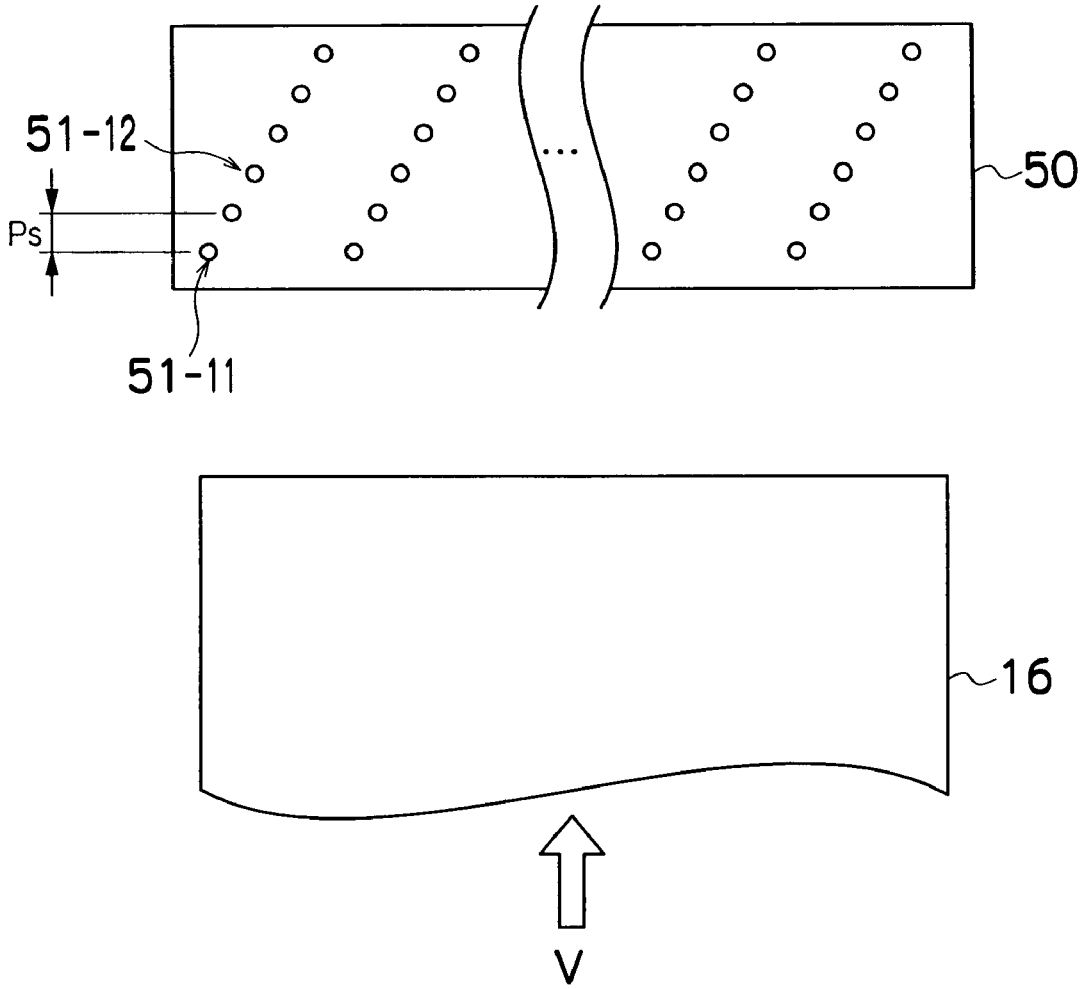
FIG. 17 is a diagram showing the relationship between ejection frequency, conveyance speed and ink permeation time.

For example, in FIG. 17, in the high-quality mode at V=40 mm/sec, $\Delta t$=12.5 msec, and the permeation time T and the ejection interval $\Delta t$ in the main scanning direction have the relationship of $T<\Delta t$.

More specifically, in ink droplets which form dots that are mutually adjacent in the main scanning direction, a subsequent ink droplet lands after a previously deposited ink droplet has permeated into the medium.

The ejection frequency f may be specified universally as f≈38 kHz, since the ejection interval at 2400 dpi is 26.5 μsec (the time required for the medium to be conveyed through 25.4/2400≈10.6 μm at a conveyance speed of 400 mm/sec).

Therefore, the switching of the switch unit 260 is controlled in such a manner that, if $T \geqq \Delta t$, then an electric field is generated by the first electrode group 120, whereas if $T<\Delta t$, then an electric field is generated by the second electrode group 202.

If the ink ejection frequency is high, then aggregation may occur in both the main scanning direction and the sub-scanning direction, but aggregation in the main scanning direction, where positional displacement caused by aggregation is added to positional displacement in the ejection direction, is more liable to cause banding in the resulting image (namely, it is more liable to be visible as banding), and therefore, the viscosity in the main scanning direction is increased by applying an electric field to the ink droplets in the main scanning direction, and thus preventing aggregation in the main scanning direction.

In the inkjet recording apparatus 10 having the composition described above, a first electrode group 120 which generates an electric field in the main scanning direction, and a second electrode group 202 which generates an electric field in the sub-scanning direction are provided, and a switching unit 280 which switches between supplying voltage to the first electrode group 120 or supplying voltage to the second electrode group 202, from a DC high-voltage generator 100. Therefore, the direction in which the electric field is generated is switched in accordance with the fixing properties and permeation properties of the recording paper 20 (media type), the conveyance speed (conveyance control) of the recording paper 20, and the ejection control of the ink droplets, thus preventing aggregation in the main scanning direction and the sub-scanning direction, and hence making it possible to obtain a desirable image in which image deterioration caused by banding, color mixing, or the like, is prevented.

The switching of the direction of the electric field may be performed in image units (for each sheet of recording paper), or it may be performed in print units (for each type of image). Moreover, the direction of the electric field may also be switched within any one image.

MODIFICATION EXAMPLE

Figure 18:
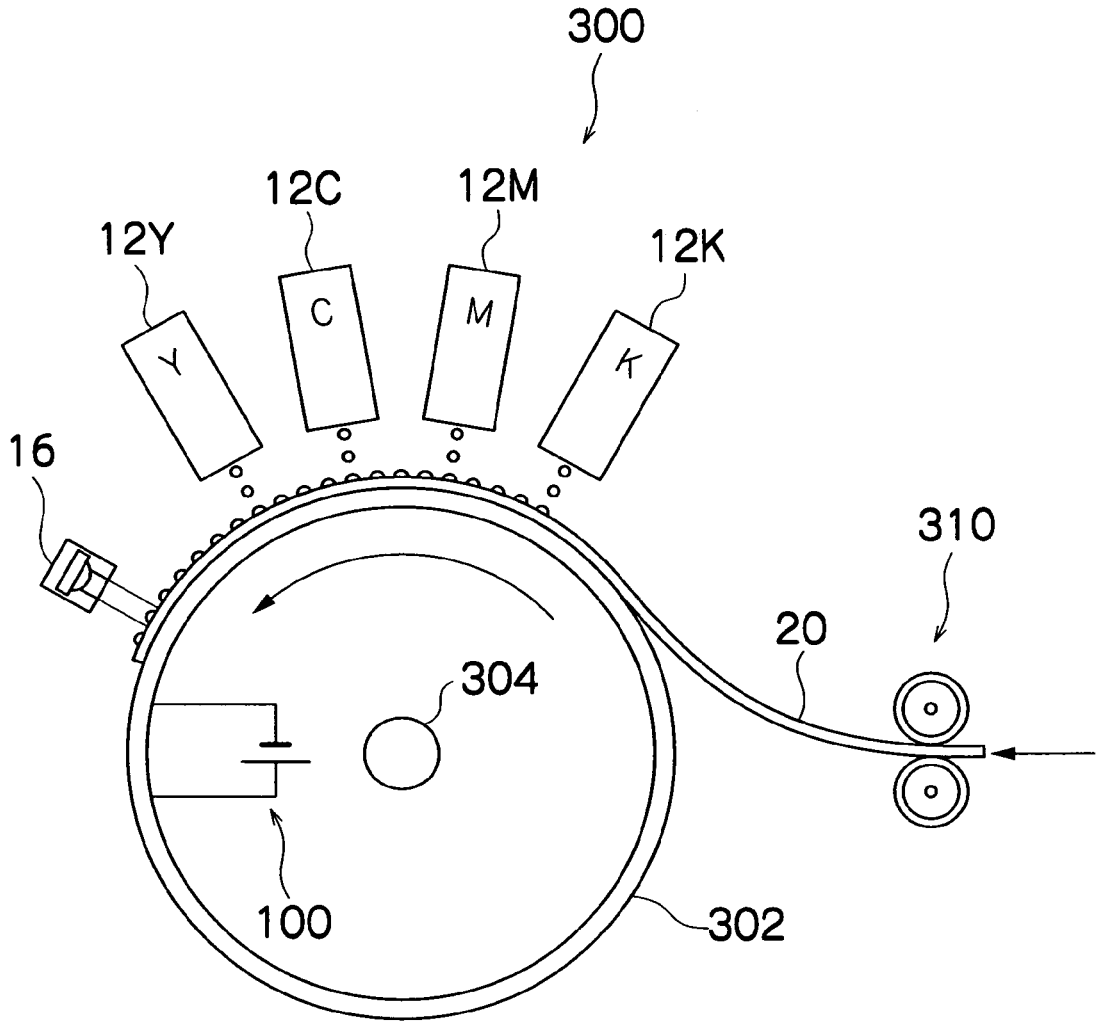
FIG. 18 is a basic compositional diagram showing a modification example of the inkjet recording apparatus shown in FIG. 1.

FIG. 18 shows an inkjet recording apparatus 300 according to a modification example of the first and second embodiments described above. FIG. 18 shows the principal part of an inkjet recording apparatus 300, and a portion of the composition of the inkjet recording apparatus 10 shown in FIG. 1 is omitted. Further, items which are the same as or similar to those in FIG. 1 are denoted with the same reference numerals and description thereof is omitted here.

The inkjet recording apparatus 300 shown in FIG. 18 comprises a roller-type electrode unit 302, instead of the belt type electrode unit 43 of the inkjet recording apparatus 10 shown in FIG. 1. The print heads 12K, 12M, 12C, and 12Y are disposed in sequence from the upstream side toward the downstream side in the direction of rotation of the roller type electrode unit 302, and the ultraviolet light source 16 is provided on the downstream side of the print head 12Y. A nip roller 310 which functions as a guide for directing the recording paper 20 to the roller type electrode unit 302 is provided on the upstream side of the print head 12K, in terms of the paper conveyance direction.

Although omitted from the drawing in FIG. 18, similarly to the belt-type electrode unit 43 shown in FIG. 15, the roller type electrode unit 302 has a structure in which a minimally conductive layer, a first electrode layer, a non-conducting layer, and a second electrode layer are laminated together in this order, from the topmost layer down.

The electrodes formed in the second electrode layer has comb-shaped positive electrodes 204 and negative electrodes 206 similar to those of the second electrode group 202 shown in FIG. 13, and a DC high-voltage is applied to these electrodes by the DC high-voltage generator 100.

In this embodiment, similarly to the first embodiment, the electric field applied to the ink droplets deposited on the recording paper 20, and the current passing through the deposited ink droplets, are suitable for raising the viscosity of ink droplets having electrorheological properties. Thereby, it is possible to prevent deposition interference, bleeding during permeation, color mixing, or the like, and hence satisfactory images can be formed.

Figure 19:
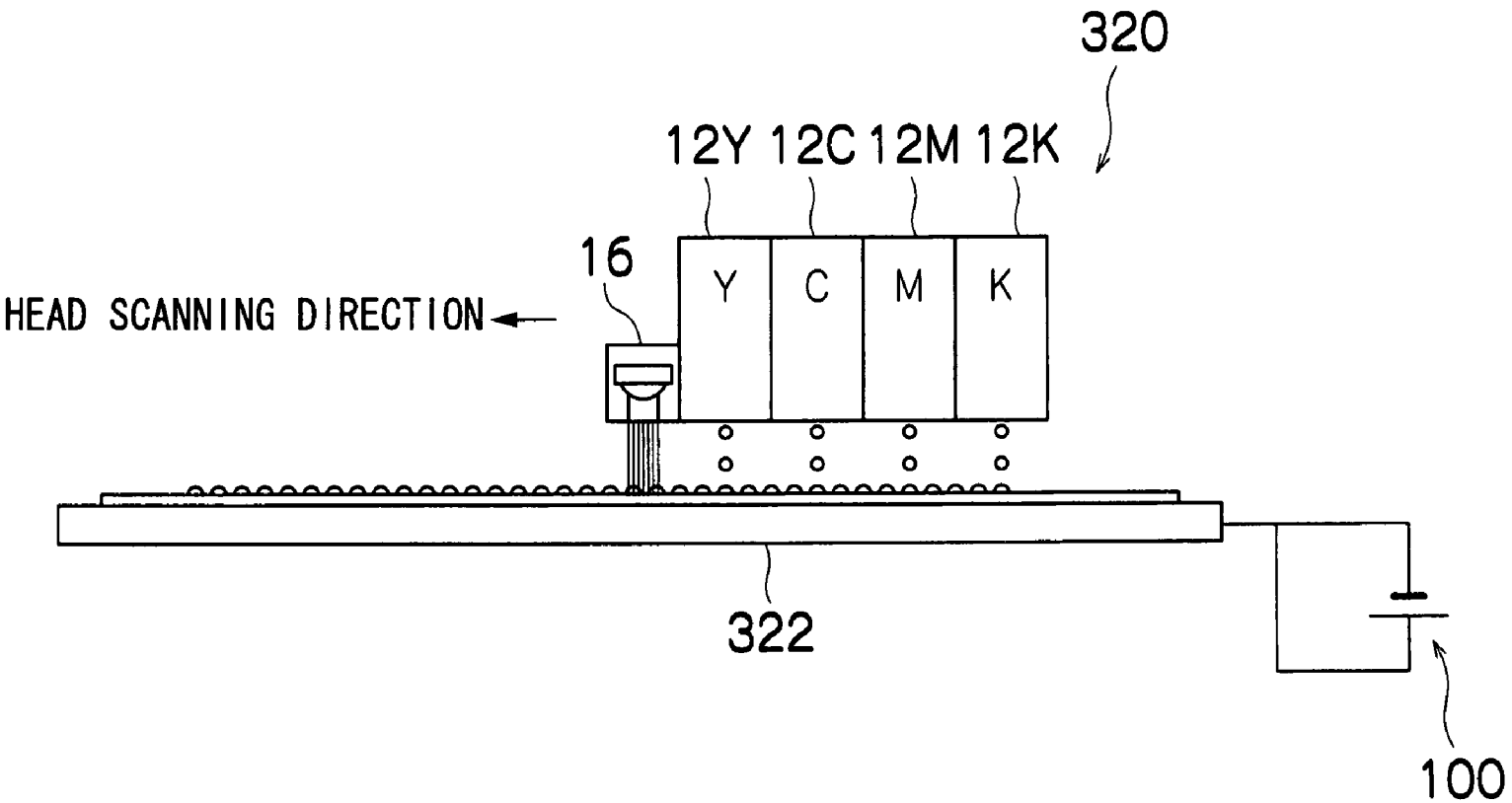
FIG. 19 is a basic compositional diagram showing a further modification example of the inkjet recording apparatus shown in FIG. 1.

Furthermore, FIG. 19 shows a further embodiment of the modification example shown in FIG. 18.

In the inkjet recording apparatus 320 shown in FIG. 19, instead of the belt-type electrode unit 43 of the inkjet recording apparatus 10 shown in FIG. 1, the print heads 12K, 12M, 12C, and 12Y and ultraviolet light source 16 are moved together as one body in the scanning direction of the heads shown by the arrow in FIG. 19, with respect to recording paper 20 which is held on a plate-shaped electrode unit 322 that is fixed in position, and the print heads 12 form an image by ejecting ink droplets onto the recording paper 20 while performing this movement. The recording paper 20 on which an image has been formed is suctioned onto a paper suction belt 324 and conveyed to a paper output unit (not illustrated).

Although not shown in FIG. 19, the plate-shaped electrode unit 322 has a structure in which a minimally conductive electrode layer, a first electrode layer, a non-conductive layer, and a second electrode layer are laminated in this order from the topmost layer down, similarly to the belt-type electrode unit 43 shown in FIG. 15.

The electrodes formed in the second electrode layer has comb-shaped positive electrodes 204 and negative electrodes 206 similar to those of the second electrode group 202 shown in FIG. 13, and a DC high-voltage is applied to these electrodes by the DC high-voltage generator 100.

In these modified embodiments, similarly to the first and second embodiments, the electric field applied to the ink droplets deposited on the recording paper 20, and the current passing through the deposited ink droplets, are suitable for raising the viscosity of ink droplets having electrorheological properties. Thereby, it is possible to prevent deposition interference, bleeding during permeation, color mixing, or the like, and hence satisfactory images can be formed.

In the above-described embodiments, an inkjet recording apparatus which records images onto a recording media by means of ink ejection from nozzles provided in a print head has been described, but the scope of application of the present invention is not limited to this, and it may also be applied broadly to liquid ejection apparatuses (dispensers, and the like), which eject liquids (water, treatment liquid, resist, and the like), onto ejection receiving media (wafers, printed substrates, and the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which forms an image on an ejection receiving medium, by ejecting liquid having electrorheological properties onto the ejection receiving medium;

a holding device which holds the ejection receiving medium on a surface facing a liquid ejection surface of the ejection head;

a conveyance device which conveys at least one of the ejection head and the ejection receiving medium held by the holding device relatively to each other in a conveyance direction;

a first electrode group which includes at least a pair of a positive electrode and a negative electrode provided in the holding device, has a lengthwise direction coinciding with a sub-scanning direction substantially parallel to the conveyance direction of the conveyance device, and is disposed so as to be aligned with the main scanning direction substantially perpendicular to the sub-scanning direction;

a first voltage supply device which supplies a prescribed voltage to the first electrode group;

a second electrode group which includes at least a pair of a positive electrode and a negative electrode disposed so as to be substantially perpendicular to the first electrode group;

a second voltage supply device which supplies a prescribed voltage to the second electrode group;

an electrode group switching device which switches between supplying the prescribed voltage to the first electrode group and supplying the prescribed voltage to the second electrode group; and an electrode group switching control device which controls the electrode group switching device in such a manner that, the prescribed voltage is supplied to the first electrode group when suppressing deposition interference on the ejection receiving medium between droplets of the liquid ejected from different ejection apertures, and the prescribed voltage is supplied to the second electrode group when suppressing deposition interference on the ejection receiving medium between droplets of the liquid ejected from a same ejection aperture.

2. The image forming apparatus as defined in claim 1, wherein:

the ejection head comprises a full-line head having at least one row of ejection apertures of a length corresponding to an image formable width of the ejection receiving medium; and single-pass driving for causing the liquid to be ejected onto the ejection receiving medium is performed by causing the ejection head to scan the ejection receiving medium only once in the sub-scanning direction.

3. The image forming apparatus as defined in claim 2, wherein the ejection head has a two-dimensional arrangement in which a plurality of ejection aperture rows are arranged in the sub-scanning direction.

4. The image forming apparatus as defined in claim 1, wherein at least a portion of the first electrode group has a structure in which the positive electrodes and the negative electrodes are arranged alternately in the main scanning direction.

5. The image forming apparatus as defined in claim 1, wherein the electrode group switching device switches between supplying the prescribed voltage to the first electrode group and supplying the prescribed voltage to the second electrode group, in accordance with at least one of a type of ejection receiving medium and data of the image to be formed on the ejection receiving medium.

6. The image forming apparatus as defined in claim 1, wherein:

planar shapes of the positive electrode and the negative electrode constituting the second electrode group are comb shapes each having a plurality of comb tooth sections; and the second electrode group has a structure in which the comb tooth sections of the positive electrode and the comb tooth sections of the negative electrode are arranged alternately.

7. The image forming apparatus as defined in claim 1, wherein the holding device has a laminated structure in which the first electrode group and the second electrode group are layered together.

* * * * *